US012233452B2

(12) United States Patent
Bell

(10) Patent No.: US 12,233,452 B2
(45) Date of Patent: Feb. 25, 2025

(54) SYSTEM AND METHOD FOR CONTOURING RING COMPONENT

(71) Applicant: ROLLS-ROYCE plc, London (GB)

(72) Inventor: Colin A Bell, Derby (GB)

(73) Assignee: ROLLS-ROYCE PLC, London (GB)

( * ) Notice: Subject to any disclaimer, the term of this patent is extended or adjusted under 35 U.S.C. 154(b) by 284 days.

(21) Appl. No.: 18/151,938

(22) Filed: Jan. 9, 2023

(65) Prior Publication Data

US 2023/0226596 A1 Jul. 20, 2023

(30) Foreign Application Priority Data

Jan. 14, 2022 (GB) ..... 2200429

(51) Int. Cl.
*B21D 1/06* (2006.01)
*B21H 1/06* (2006.01)

(52) U.S. Cl.
CPC ..... *B21H 1/06* (2013.01)

(58) Field of Classification Search
CPC ... B21D 5/14; B21D 5/06; B21D 5/08; B21D 5/086; B21D 3/14; B21D 53/16; B21H 1/06; B21H 1/22
See application file for complete search history.

(56) References Cited

U.S. PATENT DOCUMENTS

| | | | | |
|---|---|---|---|---|
| 2,243,351 | A | 5/1941 | Lowry | |
| 4,173,134 | A | 11/1979 | Huuskonen et al. | |
| 7,213,431 | B1 | 5/2007 | Hsu | |
| 2013/0008218 | A1 | 1/2013 | Roberts et al. | |
| 2018/0021842 | A1* | 1/2018 | Allwood | B21B 5/00 72/106 |
| 2020/0306817 | A1* | 10/2020 | Murai | B21B 5/00 |
| 2020/0339393 | A1* | 10/2020 | Hausladen | B21H 1/06 |

FOREIGN PATENT DOCUMENTS

| | | | |
|---|---|---|---|
| EP | 3287207 | A1 | 2/2018 |
| GB | 1 248 473 | A | 10/1971 |

OTHER PUBLICATIONS

Jun. 2, 2023 extended Search Report issued in European Patent Application No. 22212979.3.

* cited by examiner

*Primary Examiner* — Debra M Sullivan
(74) *Attorney, Agent, or Firm* — Oliff PLC

(57) ABSTRACT

A system includes a plurality of forming roller sets comprising an inner forming roller and an outer forming roller, each inner forming roller rotatable about an inner forming roller axis, each outer forming roller rotatable about an outer forming roller axis, each forming roller set being adjustable between an engagement configuration and a disengagement configuration, each forming roller set forming a profile on the ring component based on a forming roller set profile of the forming roller set, the system also including an actuating unit which controls the engagement and a disengagement of the forming roller sets with the ring component.

15 Claims, 16 Drawing Sheets

136,136-1
138,138-1
140,140-1
142,142-1

136
138,138-1
140,140-1
142,142-1
144

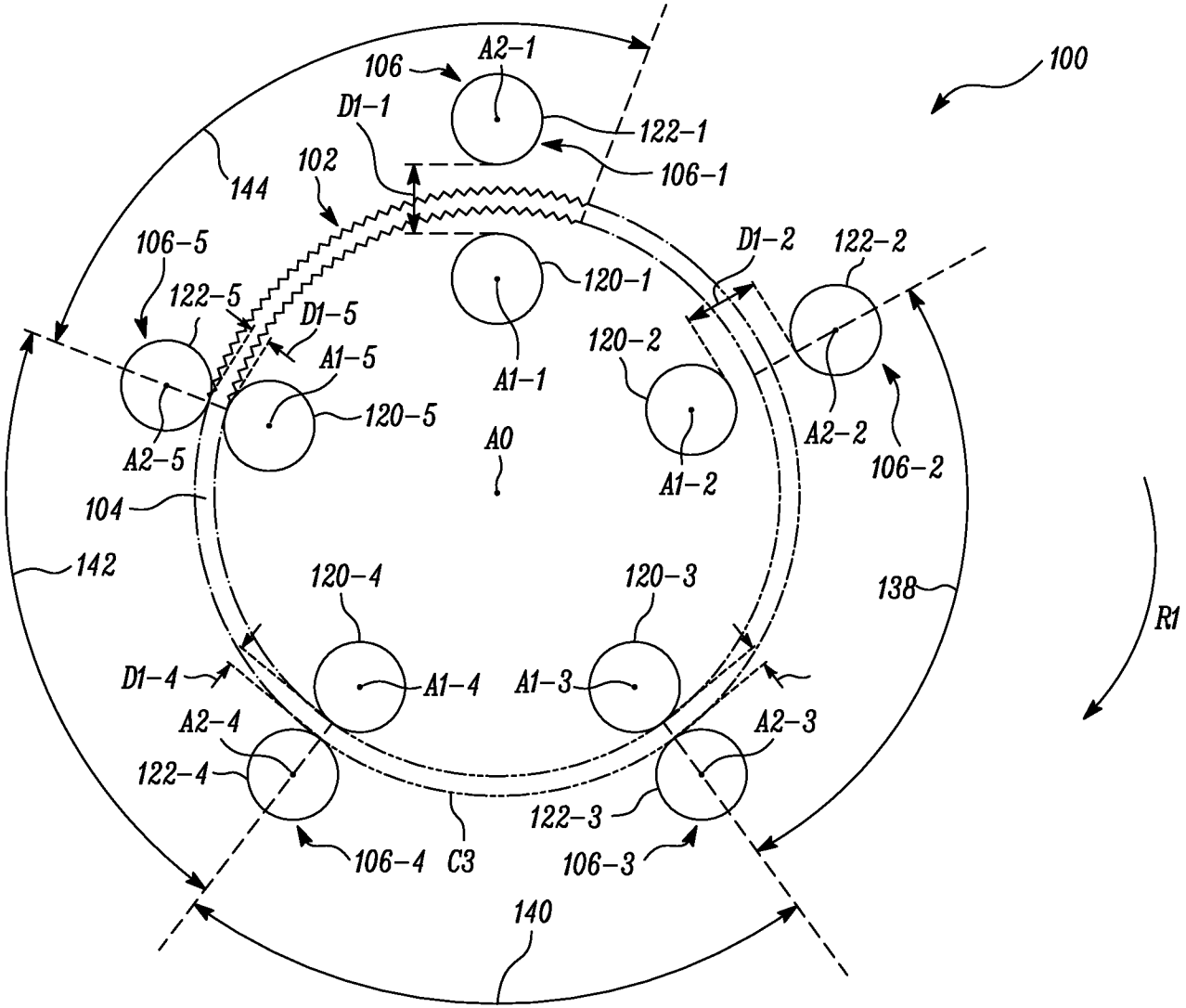
FIG. 7B
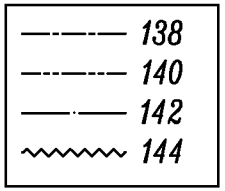

140
142
144

SYSTEM AND METHOD FOR CONTOURING RING COMPONENT

CROSS-REFERENCE TO RELATED APPLICATIONS

This specification is based upon and claims the benefit of priority from United Kingdom patent application GB2200429.5 filed on Jan. 14, 2022, the entire contents of which is incorporated herein by reference.

BACKGROUND

Field of the Disclosure

The present disclosure relates to a system and a method for contouring a ring component.

Description of the Related Art

A forming process, such as, a contour roll forming process or a vertical roll forming process, may be used to define a profile on a component. In an example, the forming process may be used to define a profile on a ring-shaped component, such as, a liner, a seal, and the like. In some examples, the ring-shaped component may be associated with a gas turbine engine. For example, the ring-shaped component may include an anti-fret liner, an interstage seal, a heat shield, a shroud, and the like. For a ring-shaped component, the profile may correspond to a shape defined on an outer circumferential surface, an inner circumferential surface, or both outer and inner circumferential surfaces of the ring-shaped component.

When a ring-shaped component is being manufactured by the contour roll forming process, a number of roller sets arranged in series may be used to achieve a desired profile on a metal strip. After forming the desired profile, the metal strip may be bent to form a ring-shaped structure. Subsequently, opposing ends of the metal strip may be welded to form the ring-shaped component. In some examples, the desired profile may have a complex and/or intricate shape which may present challenges during a welding process of the metal strip. More particularly, the complex and/or intricate shape of the desired profile may not provide sufficient space for a weld head to access the desired profile for welding of the opposing ends due to the creation of bends or features in the sheet metal inconducive to welding.

Further, a process of manufacturing a ring-shaped component using the vertical roll forming process may typically include bending of a metal strip to form a ring-shaped structure prior to the addition of a profile. Moreover, opposing ends of the metal strip may be welded to form the ring-shaped component. Subsequently, a first roller set may be used to define a first profile on the ring-shaped component. Further, the ring-shaped component may be subjected to a heat treatment process between rolling stages or after the final shape has been reached to relieve stress and increase ductility. For example, the ring-shaped component may be annealed after formation of the first profile by the first roller set using a heat treatment process. The ring-shaped component is then removed from the vertical roll former, and the first roller set is replaced with a second roller set with a different profile to the first roller set. The ring-shaped component is then replaced onto the vertical roll former, and the second roller set is used to define a second profile on the ring-shaped component. This can be followed by another heat treatment process, and further profiling using further replacement roller sets, until a desired profile is defined on the ring-shaped component. Thus, in conventional vertical roll forming processes, the ring-shaped component may have to be repeatedly removed from and installed on a vertical roller frame or set-up which may increase time and costs associated with the manufacturing of the ring-shaped component.

SUMMARY OF THE DISCLOSURE

In a first aspect, there is provided a system for contouring a ring component, the system comprising a frame, a plurality of forming roller sets mounted to the frame, each of the plurality of forming roller sets comprising an inner forming roller and an outer forming roller, the forming roller sets being arranged around a system axis such that, in use, the ring component passes between the inner forming roller and outer forming roller of each forming roller set, wherein each inner forming roller is configured to rotate about its respective inner forming roller axis, and each the outer forming roller is configured to rotate about its respective outer forming roller axis, the inner forming roller axes being closer to the system axis than the outer forming roller axes, the inner forming rollers and the outer forming rollers being adjustable between at least an engagement configuration and a disengagement configuration, wherein, when in the engagement configuration, the inner forming roller and the outer forming roller of each forming roller set define in a space therebetween a forming roller set profile, such that, upon an engagement with the ring component, each forming roller set is configured to form a profile on the ring component based on the forming roller set profile of the forming roller set, the forming roller set profiles of at least two forming roller sets being different from each other, and an actuating unit operably coupled to the plurality of forming roller sets, wherein the actuating unit is configured to control a configuration of the inner forming rollers and the outer forming rollers of the plurality of forming roller sets so as to control a timing of the engagement and a disengagement of the plurality of forming roller sets with the ring component, wherein the actuating unit is further configured to engage each of the forming roller sets so as to form each forming roller set profile on at least 360 degrees of the ring component, and wherein the timing of the engagement of each forming roller set with the ring component is staggered with respect to each of the other forming roller sets.

The system for contouring the ring component described herein may combine advantages of a contour roll forming process and a vertical roll forming process. The system is more cost-effective and reduces the time required for manufacturing the ring component. Further, the ring component can be welded before contouring the ring component. Thus, the ring component manufactured by the system may include any complex and/or intricate profile as no welding is required after the profile is formed on the ring component. Moreover, the system described herein eliminates the requirement of frequent removal of the ring component for heat treatment processes and to allow the roller sets to be exchanged, as multiple forming roller sets may be arranged such that the forming roller sets can apply multiple profiles using the same one vertical roller system, and constrain the material of the ring component to avoid spring back.

The actuating unit can be configured to control the engagement and the disengagement of each forming roller set by changing a distance between the inner forming roller and the outer forming roller of the forming roller set.

The plurality of forming roller sets can include a first forming roller set including a first forming roller set profile. Further, the plurality of forming roller sets includes a final forming roller set adjacent to the first forming roller set and including a final forming roller set profile. Moreover, the plurality of forming roller sets includes one or more intermediate forming roller sets disposed around the periphery of a circle between the first forming roller set and the final forming roller set. Each intermediate forming roller set includes an intermediate forming roller set profile. An arrangement of the first forming roller set, the intermediate forming roller sets, and the final forming roller set may constrain the material of the ring component which may in turn eliminate spring back of the material of the ring component during contouring of the ring component.

The actuating unit can be further configured to engage the first forming roller set with the ring component while other forming roller sets from the plurality of forming roller sets are disengaged from the ring component. The actuating unit is further configured to engage the one or more intermediate forming roller sets with the ring component one after the other while the first forming roller set is engaged with the ring component. The actuating unit is further configured to engage the final forming roller set with the ring component while the first forming roller set and the one or more intermediate forming roller sets are engaged with the ring component. The actuating unit is further configured to disengage the first forming roller set from the ring component while the final forming roller set and the one or more intermediate forming roller sets are engaged with the ring component. The actuating unit is further configured to disengage the one or more intermediate forming roller sets from the ring component one after the other after the first forming roller set is disengaged from the ring component and while the final forming roller set is engaged with the ring component. The actuating unit is further configured to disengage the final forming roller set after the one or more intermediate forming roller sets are disengaged from the ring component. Thus, the actuating unit described herein may allow selective engagement and/or disengagement of the forming roller sets which may allow precise control over the formation of a shape of the profile.

The actuating unit can be further configured to engage at least one intermediate forming roller set with the ring component after a portion of the ring component formed with the forming roller set profile of a previous adjacent forming roller set passes the at least one intermediate forming roller set. The actuating unit is further configured to engage the final forming roller set with the ring component after a portion of the ring component formed with the intermediate forming roller set profile of an adjacent intermediate forming roller set passes the final forming roller set. The technique of engaging a particular forming roller set after passage of a portion of the ring component formed by a previous adjacent forming roller set may ensure a gradual change in the shape of the profile and may also ensure that each portion of the ring component includes the profile. Further, this may ensure that a portion of the ring component formed by the final forming roller set is not adjacent to a portion of the ring component formed by the first forming roller set, thereby preventing any abrupt change in the shape of the ring component. Moreover, the engaging and the disengaging of the forming roller sets at different intervals of time may ensure that the whole circumference of the ring component includes the profile.

The actuating unit can be further configured to disengage each forming roller set from the ring component at least after a whole circumference of the ring component has been formed with the corresponding forming roller set. This technique may ensure that the profile is formed on an entire circumferential surface of the ring component. It is important to note that this does not mean the whole of the circumference of the ring component has to have the same one profile at any one time, but rather that every part of the ring component has, at some point during the process, been formed into the particular profile. This will be apparent, as the ring component can undergo multiple stages of profiling during a single rotation, meaning that, whilst each part of the ring component will have had each profile applied to it during the process, at any given moment the different parts of the ring component will have different profiles applied to them, as will be explained.

The forming roller set profiles of the plurality of forming roller sets can be different from each other.

The system can further include one or more non-forming roller sets configured to selectively engage with and disengage from the ring component. The actuating unit is further configured to engage the one or more non-forming roller sets with the ring component at least while at least one forming roller set from the plurality of forming roller sets is engaged with the ring component. The non-forming roller sets may provide support to the ring component and may also reduce a possibility of spring back of the ring component.

The system can further include a heating element disposed between at least two forming roller sets from the plurality of forming roller sets. The heating element is configured to locally heat a portion of the ring component disposed between the at least two forming roller sets. The heating element may be used to increase temperature of the ring-shaped component during forming which will lead to an increase in ductility and formability. Moreover, the heating element may eliminate a need of frequent removal of the ring component for heat treatment processes during the contouring of the ring component.

In a second aspect, there is provided a method for contouring a ring component. The method includes providing a plurality of forming roller sets. Each of the plurality of forming roller sets include an inner forming roller configured to rotate about an inner forming roller axis, and an outer forming roller configured to rotate about an outer forming roller axis. The forming roller sets are arranged around a system axis such that a ring component can pass between the inner forming roller and outer forming roller of each forming roller set. The inner forming roller axis is closer to the system axis than the outer forming roller axis. Each forming roller set is adjustable between at least an engagement configuration and a disengagement configuration. When in the engagement configuration, the inner forming roller and the outer forming roller define in a space therebetween a forming roller set profile, such that, upon an engagement with the ring component, each forming roller set is configured to form a profile on the ring component based on the forming roller set profile of the forming roller set. The forming roller set profiles of at least two forming roller sets are different from each other. The method also includes selectively engaging the plurality of forming roller sets with the ring component. The method further includes selectively disengaging the plurality of forming roller sets from the ring component. The method includes selectively rotating each forming roller set at least while each forming roller set is engaged with the ring component so as to form each forming roller set profile on at least 360 degrees of the ring component, the timing of the engagement of each forming roller set with the ring component being staggered with respect to each of the other forming roller sets.

The method can further include engaging a first forming roller set from the plurality of forming roller sets with the ring component while other forming roller sets from the plurality of forming roller sets are disengaged from the ring component. The first forming roller set includes a first forming roller set profile. The method further includes engaging one or more intermediate forming roller sets from the plurality of forming roller sets with the ring component one after the other while the first forming roller set is engaged with the ring component. Each intermediate forming roller set includes an intermediate forming roller set profile. The method further includes engaging a final forming roller set from the plurality of forming roller sets with the ring component while the first forming roller set and the one or more intermediate forming roller sets are engaged with the ring component. The one or more intermediate forming roller sets from the plurality of forming roller sets are circumferentially disposed between the first forming roller set and the final forming roller set. The final forming roller set includes a final forming roller set profile. The method further includes disengaging the first forming roller set from the ring component while the final forming roller set and the one or more intermediate forming roller sets are engaged with the ring component. The method further includes disengaging the one or more intermediate forming roller sets from the ring component one after the other after the first forming roller set is disengaged from the ring component and while the final forming roller set is engaged with the ring component. The method further includes disengaging the final forming roller set after the one or more intermediate forming roller sets are disengaged from the ring component.

Engaging the one or more intermediate forming roller sets with the ring component can further include engaging at least one intermediate forming roller set with the ring component after a portion of the ring component formed with the forming roller set profile of a previous adjacent forming roller set passes the at least one intermediate forming roller set. Further, engaging the final forming roller set with the ring component further includes engaging the final forming roller set with the ring component after a portion of the ring component formed with the intermediate forming roller set profile of an adjacent intermediate forming roller set passes the final forming roller set.

The method can further include disengaging each roller set at least after a whole circumference of the ring component is formed with the corresponding forming roller set.

The method can further include selectively engaging one or more non-forming roller sets with the ring component at least while at least one forming roller set from the plurality of forming roller sets is engaged with the ring component.

The method can further include selectively engaging the plurality of forming roller sets with the ring component such that the ring component is constrained and does not spring back during contouring.

The method can further include locally heating a portion of the ring component disposed between at least two forming roller sets from the plurality of forming roller sets.

The method can further include movably mounting the plurality of forming roller sets to a frame.

The present disclosure may relate to contouring of different ring components or annular components. In some examples, the ring component may be associated with gas turbine engines. For example, the ring component may include an anti-fret liner, a seal, such as, an interstage seal, a heat shield, a shroud, and the like.

BRIEF DESCRIPTION OF THE DRAWINGS

The disclosure will now be described by way of example only, with reference to the Figures, in which:

FIG. 7B is a schematic view illustrating the first intermediate forming roller set disengaged from the ring component of FIG. 2A;

DETAILED DESCRIPTION OF THE DISCLOSURE

Aspects of the present disclosure will now be discussed with reference to the accompanying Figures. Further aspects will be apparent to those skilled in the art.

Figure 1:
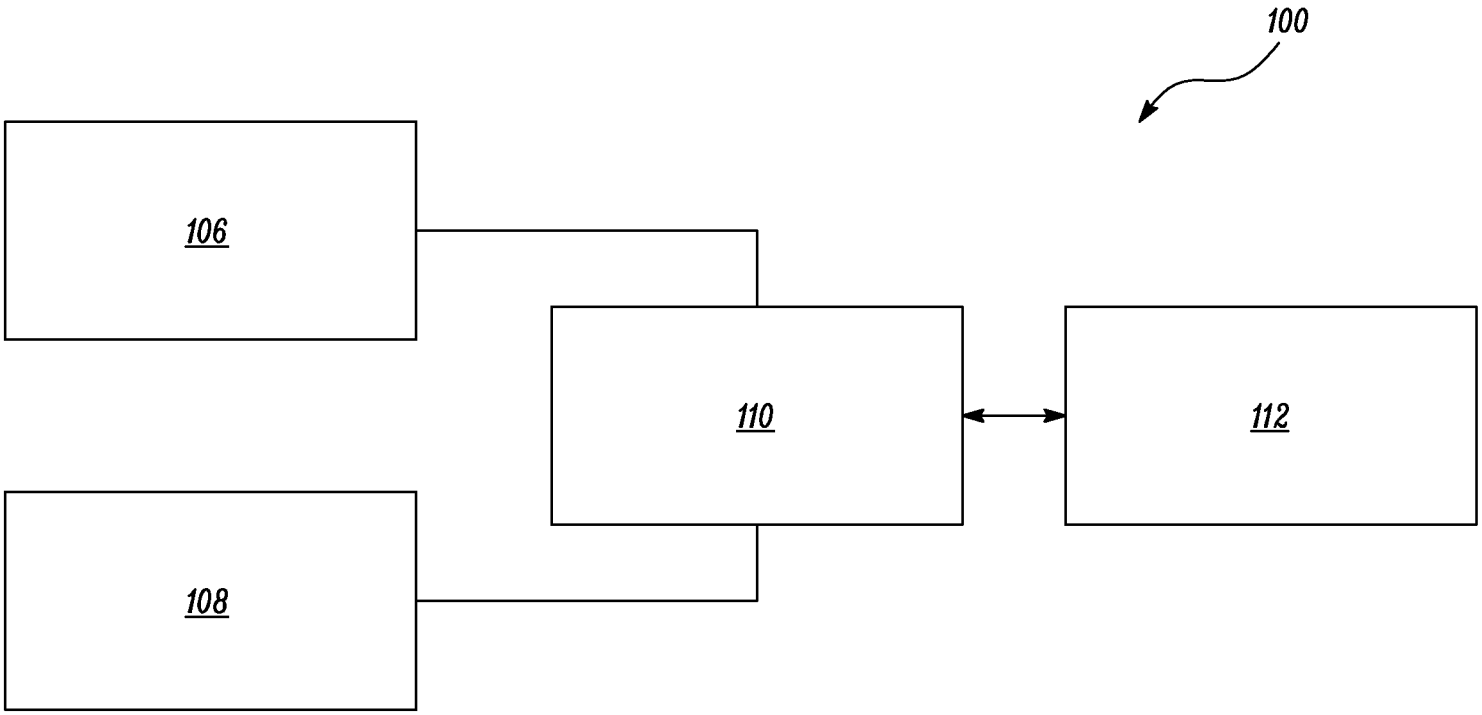
FIG. 1 is a block diagram of a system for contouring a ring component according to the present disclosure.
Figure 2A:
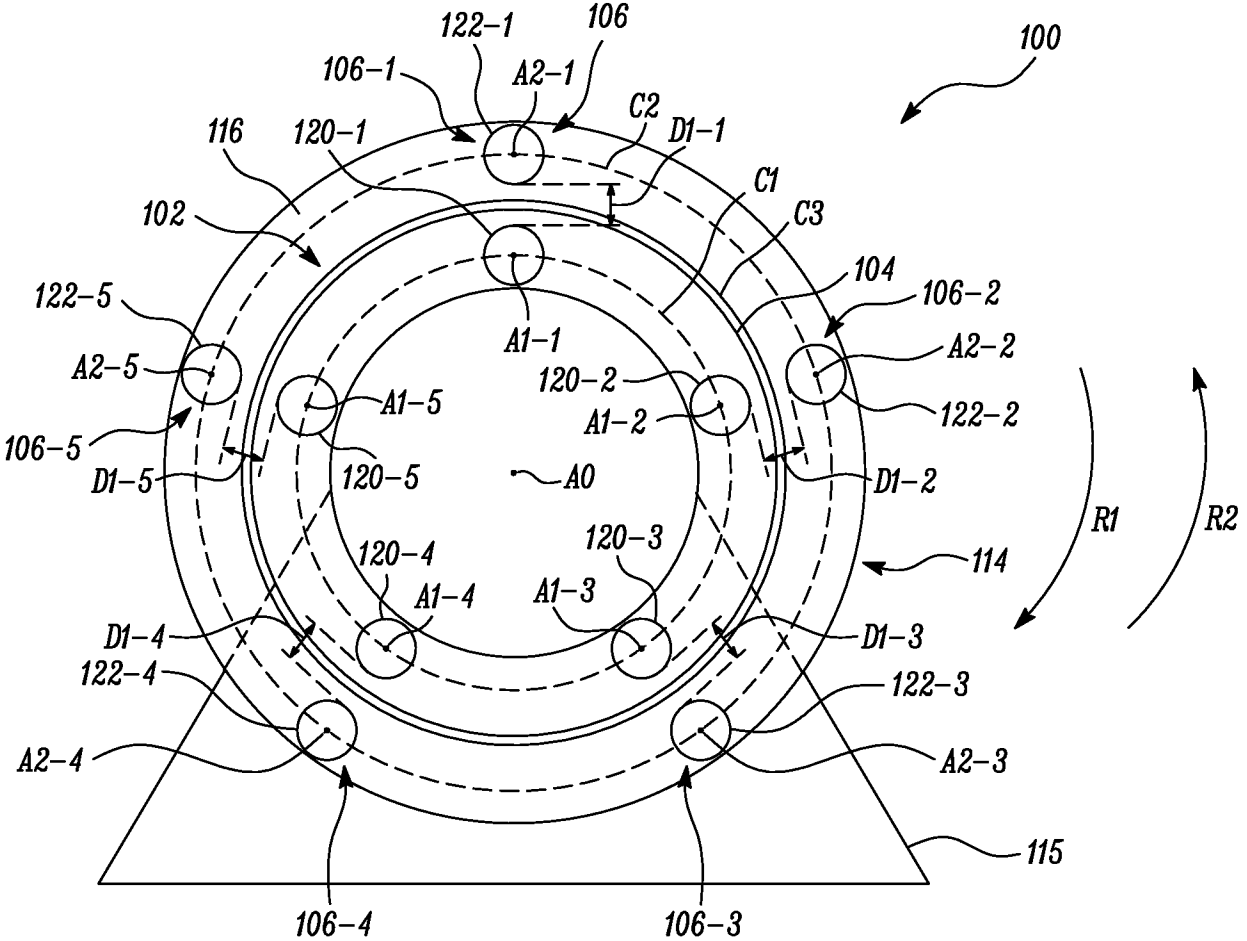
FIG. 2A illustrates a schematic view of a plurality of forming roller sets associated with the system of FIG. 1 according to the present disclosure.

FIG. 1 illustrates a block diagram of a system 100 for contouring a ring component 102 (shown in FIG. 2A). The ring component 102 may be manufactured based on one or more operations performed on a strip 104. The strip 104 may include, for example, a metal strip. In an example, the strip 104 may be made of, for example, sheet metal.

The system 100 includes a plurality of forming roller sets 106. Each of the plurality of forming roller sets 106 includes an inner forming roller 120-1, 120-2, 120-3, 120-4, 120-5 and an outer forming roller 122-1, 122-2, 122-3, 122-4, 122-5 (see FIG. 2A). The plurality of forming roller sets 106 may be generally used for contouring the ring component 102. The system 100 may also include one or more non-forming roller sets 108. The plurality of forming roller sets 106 and the one or more non-forming roller sets 108 may together support, guide, and/or constrain the ring component 102 to avoid spring back of the ring component 102 during contouring of the ring component 102. The system 100 further includes an actuating unit 110 configured to selectively engage and/or disengage the plurality of forming roller sets 106 and if present the one or more non-forming roller sets 108 with the ring component 102 during contouring.

Further, the system 100 includes a controller 112. The controller 112 is communicably coupled to the actuating unit 110. The controller 112 may generate and transmit control signals to the actuating unit 110. Based on the control signals received from the controller 112, the actuating unit 110 may move the plurality of forming roller sets 106 and the non-forming roller sets 108 for contouring of the ring component 102. The controller 112 may embody a single microprocessor or multiple microprocessors.

Numerous commercially available microprocessors may be configured to perform the functions of the controller 112. A person of ordinary skill in the art will appreciate that the controller 112 may include multiple components for performing intended functions/operations.

FIG. 2A illustrates a schematic view of the system 100 for contouring the ring component 102. The system 100 includes a frame 114, such that each of the plurality of forming roller sets 106 may be movably mounted to the frame 114. Further, the non-forming roller sets 108 (see FIG. 4) are movably mounted to the frame 114. Moreover, the frame 114 rotatably supports the ring component 102. The frame 114 may include a base member 115 and a mounting structure 116. The plurality of forming roller sets 106 and the one or more non-forming roller sets 108 may be movably mounted to the mounting structure 116. The frame 114 may include various components, such as, linkages, shafts, and the like, that may facilitate mounting of the plurality of forming roller sets 106, the non-forming roller sets 108, and the ring component 102 thereon.

In the example of FIG. 2A, the plurality of inner forming rollers 120-1, 120-2, 120-3, 120-4, 120-5 are disposed around a periphery of a first circle C1, and the plurality of outer forming rollers 122-1, 122-2, 122-3, 122-4, 122-5 are disposed around a periphery of a second circle C2. The inner forming rollers are configured to rotate about their respective inner forming roller axes A1-1, A1-2, A1-3, A1-4, A1-5, and the outer forming rollers 122-1, 122-2, 122-3, 122-4, 122-5 are configured to rotate about their respective outer forming roller axes A2-1, A2-2, A2-3, A2-4, A2-5. In the example of FIG. 2A, the inner forming roller axes are arranged on the first circle C1, and the outer forming roller axes are arranged on the second circle C2, the first and second circles C1, C2 being centred on a system axis A0. It will be appreciated that not all of the inner forming rollers will necessarily have the same diameter, and so as such may not be positioned such that their respective axes are exactly on the first circle C1. Equally, not all of the outer forming rollers will necessarily have the same diameter, and so as such may not be positioned such that their respective axes are exactly on the second circle C2. The arrangements shown here are for exemplary purposes only, and the skilled person will appreciate that whilst the exact location of the rotation axes of the inner and outer forming rollers may vary, the key feature is that they are arranged in a circular manner such that they are spaced around the ring component when in use on the device. Further, the plurality of forming roller sets 106 includes a first forming roller set 106-1 including a first forming roller set profile 118-1 (shown in FIG. 3A). Further, the plurality of forming roller sets 106 includes a final forming roller set 106-5 adjacent to the first forming roller set 106-1 and including a final forming roller set profile 118-5 (shown in FIG. 3E).

Further, the plurality of forming roller sets 106 includes one or more intermediate forming roller sets 106-2, 106-3, 106-4 disposed around the periphery of the circle C1, C2 between the first forming roller set 106-1 and the final forming roller set 106-5. Each of the one or more intermediate forming roller sets 106-2, 106-3, 106-4 comprises an intermediate forming roller set profile 118-2, 118-3, 118-4 (shown in FIGS. 3B, 3C, 3D, respectively). More particularly, in the example of FIG. 2A which includes three intermediate forming roller sets, the one or more intermediate forming roller sets 106-2, 106-3, 106-4 includes a first intermediate forming roller set 106-2 including a first intermediate forming roller set profile 118-2, a second intermediate forming roller set 106-3 including a second intermediate forming roller set profile 118-3, and a third intermediate forming roller set 106-4 including a third intermediate forming roller set profile 118-4. It will be understood that the number of intermediate forming roller sets can vary depending on the complexities of the contours to be imparted to the ring component.

In the example of FIG. 2A the plurality of forming roller sets 106 comprises five forming roller sets 106-1, 106-2, 106-3, 106-4, 106-5. Although the system 100 described herein includes five forming roller sets 106-1, 106-2, 106-3, 106-4, 106-5, it may be contemplated that the system 100 may include more than five forming roller sets or less than five forming roller sets, as per application requirements which are generally defined by the complexity of the contours to be imparted.

Each of the plurality of forming roller sets 106 includes an inner forming roller 120-1, 120-2, 120-3, 120-4, 120-5 and an outer forming roller 122-1, 122-2, 122-3, 122-4, 122-5. The inner forming roller 120-1, 120-2, 120-3, 120-4, 120-5 is configured to rotate about an inner forming roller axis A1-1, A1-2, A1-3, A1-4, A1-5. Further, the outer forming roller 122-1, 122-2, 122-3, 122-4, 122-5 is configured to rotate about an outer forming roller axis A2-1, A2-2, A2-3, A2-4, A2-5. Moreover, the inner forming roller axis A1-1, A1-2, A1-3, A1-4, A1-5 is closer to the system axis A0 than the outer forming roller axis A2-1, A2-2, A2-3, A2-4, A2-5.

The inner forming rollers 120-1, 120-2, 120-3, 120-4, 120-5 are disposed around the circle C1. Further, the outer forming roller 122-1, 122-2, 122-3, 122-4, 122-5 are disposed around the circle C2.

Therefore, each forming roller set 106 (see FIG. 2A) includes a corresponding inner forming roller 120 configured to rotate about a corresponding inner forming roller axis A1 and a corresponding outer forming roller 122 configured to rotate about a corresponding outer forming roller axis A2.

Figure 2B:
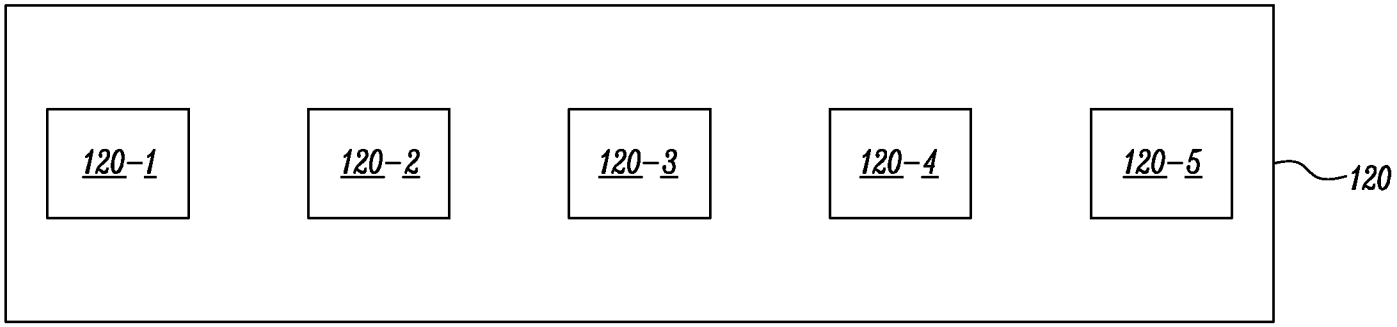
FIG. 2B illustrates a block diagram of a plurality of inner forming rollers associated with the system of FIG. 1 according to the present disclosure.

Referring to FIG. 2A, the inner forming rollers 120-1, 120-2, 120-3, 120-4, 120-5 are configured to selectively rotate about their respective inner forming roller axes A1-1, A1-2, A1-3, A1-4, A1-5. Similarly, the outer forming rollers 122-1, 122-2, 122-3, 122-4, 122-5 are configured to selectively rotate about their respective outer forming roller axes A2-1, A2-2, A2-3, A2-4, A2-5. The controller 112 (shown in FIG. 1) can selectively rotate each of the inner forming rollers 120 (see FIG. 2B) and each of the outer forming rollers 122 (see FIG. 2B) via the actuating unit 110 (see FIG. 1).

The first forming roller set 106-1 includes the first inner forming roller 120-1 that rotates about the first inner forming roller axis A1-1 and the first outer forming roller 122-1 that rotates about the first outer forming roller axis A2-1. As illustrated in FIG. 2A, a distance D1-1 may be defined between the first inner forming roller 120-1 and the first outer forming roller 122-1.

Further, the first intermediate forming roller set 106-2 comprises the first inner forming roller 120-2 that rotates about the first inner forming roller axis A1-2 and the first outer forming roller 122-2 that rotates about the first outer forming roller axis A2-2. As illustrated in FIG. 2A, a distance D1-2 may be defined between the inner forming roller 120-2 and the outer forming roller 122-2.

Additionally, the second intermediate forming roller set 106-3 comprises the second inner forming roller 120-3 that rotates about the second inner forming roller axis A1-3 and the second outer forming roller 122-3 that rotates about the second outer forming roller axis A2-3. As illustrated in FIG. 2A, a distance D1-3 may be defined between the second inner forming roller 120-3 and the second outer forming roller 122-3.

Moreover, the third intermediate forming roller set 106-4 comprises the third inner forming roller 120-4 that rotates about the third inner forming roller axis A1-4 and the third outer forming roller 122-4 that rotates about the third outer forming roller axis A2-4. As illustrated in FIG. 2A, a distance D1-4 may be defined between the third inner forming roller 120-4 and the third outer forming roller 122-4.

Further, the final forming roller set 106-5 comprises the fourth inner forming roller 120-5 that rotates about the fourth inner forming roller axis A1-5 and the fourth outer forming roller 122-5 that rotates about the fourth outer forming roller axis A2-5. As illustrated in FIG. 2A, a distance D1-5 may be defined between the fourth inner forming roller 120-5 and the fourth outer forming roller 122-5.

Figure 2C:
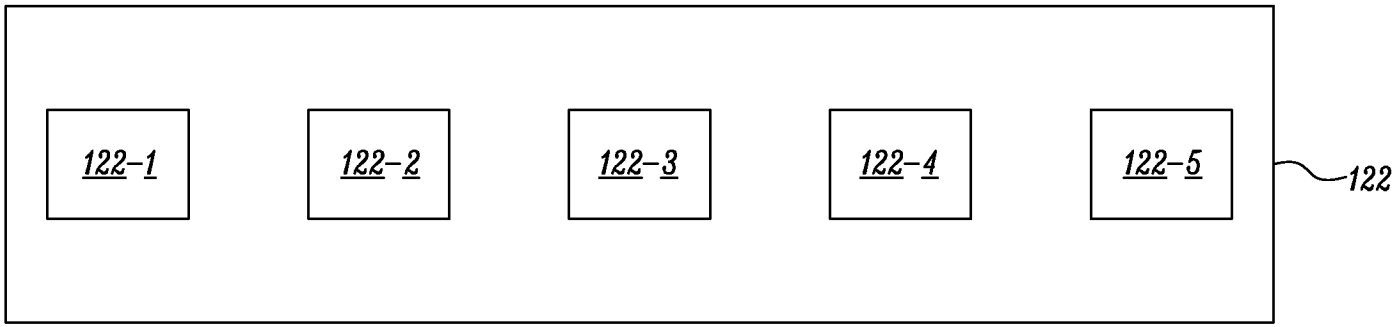
FIG. 2C illustrates a block diagram of a plurality of inner forming rollers associated with the system of FIG. 1 according to the present disclosure.
Figure 6A:
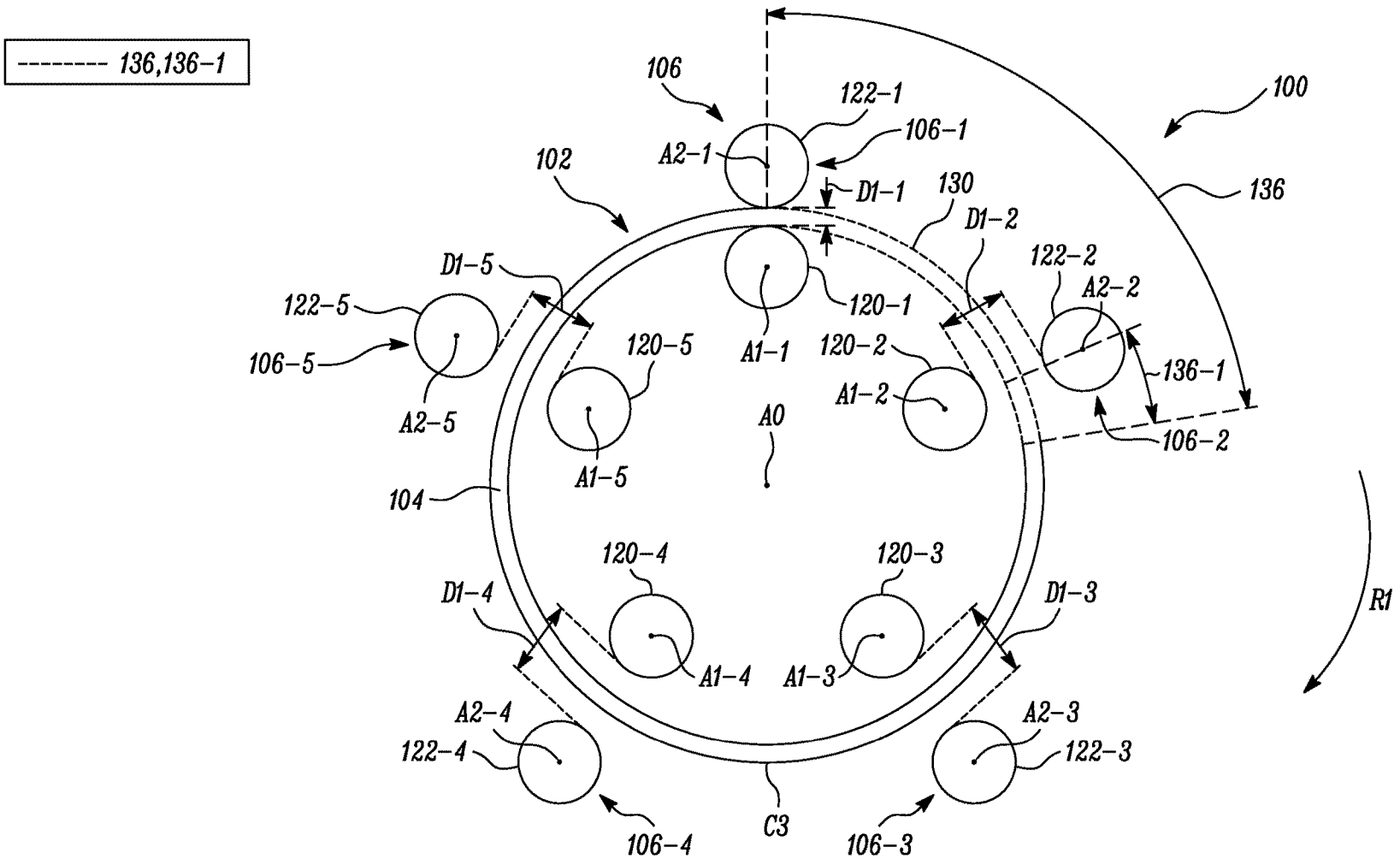
FIG. 6A is a schematic view illustrating the first forming roller set and the first intermediate forming roller set in engagement with the ring component of FIG. 2A.
Figure 6B:
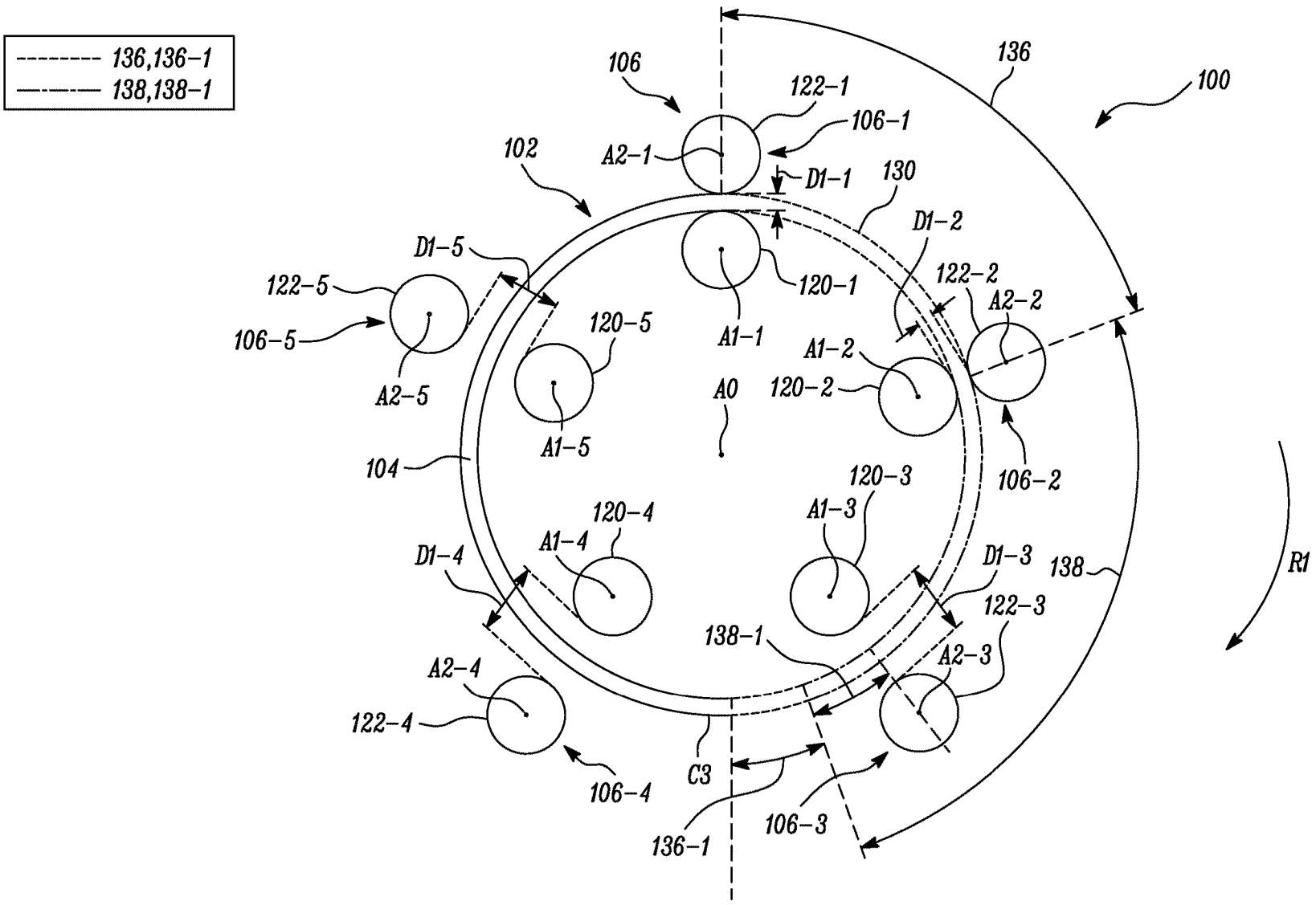
FIG. 6B is a schematic view illustrating the second intermediate forming roller set in engagement with the ring component of FIG. 2A.
Figure 6C:
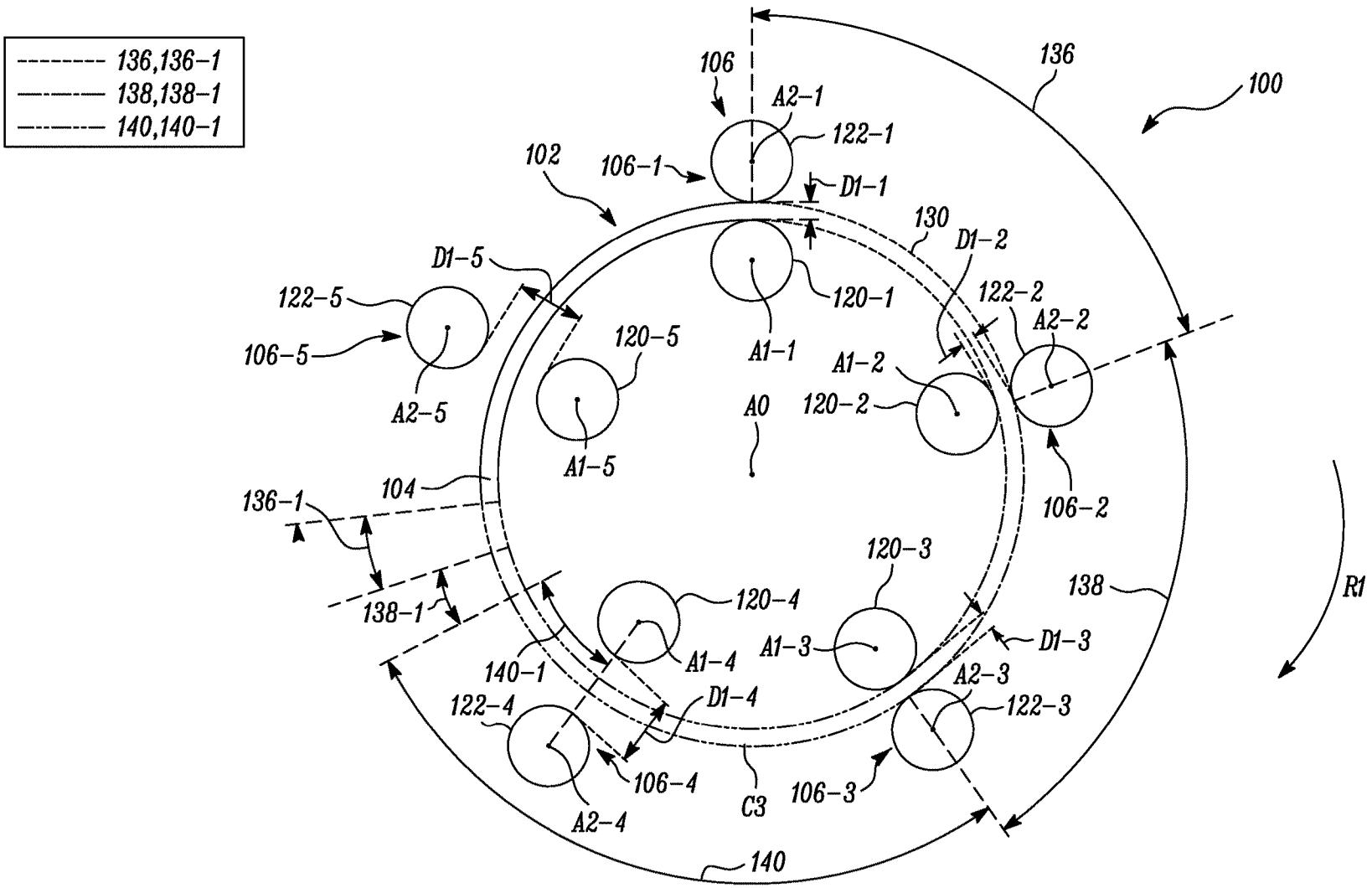
FIG. 6C is a schematic view illustrating the third intermediate forming roller set in engagement with the ring component of FIG. 2A.
Figure 6D:
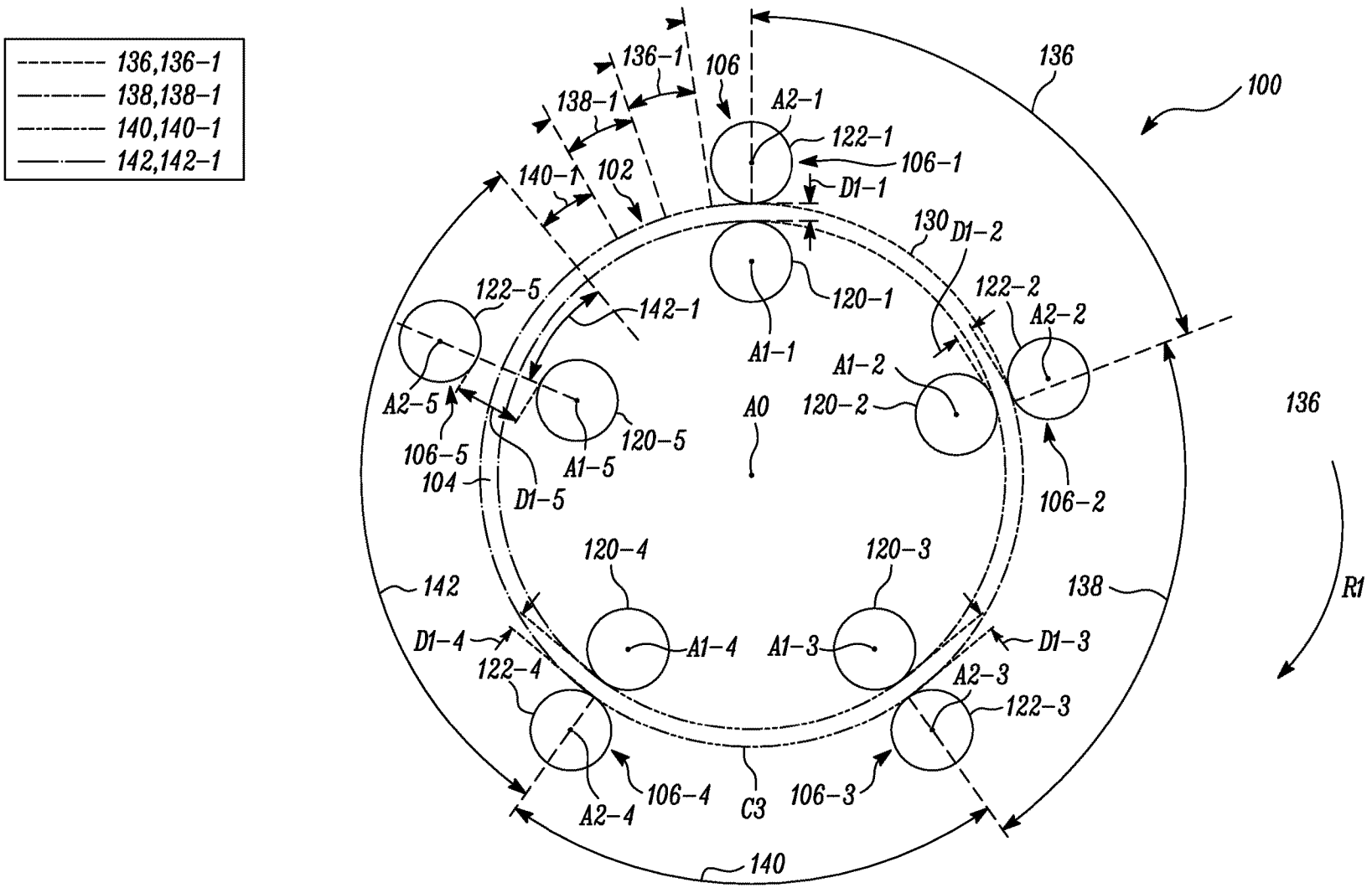
FIG. 6D is a schematic view illustrating the fourth intermediate forming roller set in engagement with the ring component of FIG. 2A.

Further, the inner forming rollers 120 and the outer forming rollers 122 are adjustable between at least an engagement configuration (as shown in FIG. 6D) and a disengagement configuration (as shown in FIG. 2A). Referring to FIGS. 3A to 3E, when in the engagement configuration, the inner forming rollers 120 (see FIG. 2B) and the outer forming rollers 122 (see FIG. 2C) each define in a space 124-1, 124-2, 124-3, 124-4, 124-5 (shown in FIGS. 3A, 3B, 3C, 3D, 3E, respectively) therebetween to form forming roller set profiles 118-1, 118-2, 118-3, 118-4, 118-5 (shown in FIGS. 3A, 3B, 3C, 3D, 3E, respectively), such that, upon an engagement with the ring component 102, each forming roller set 106 is configured to form a profile 130 (shown in FIGS. 6A to 6D and 7C to 7E) on the ring component 102 based on the forming roller set profile 118-1, 118-2, 118-3, 118-4, 118-5 of the forming roller set 106-1, 106-2, 106-3, 106-4, 106-5.

Figures 3A, 3B, 3C, 3D, 3E:
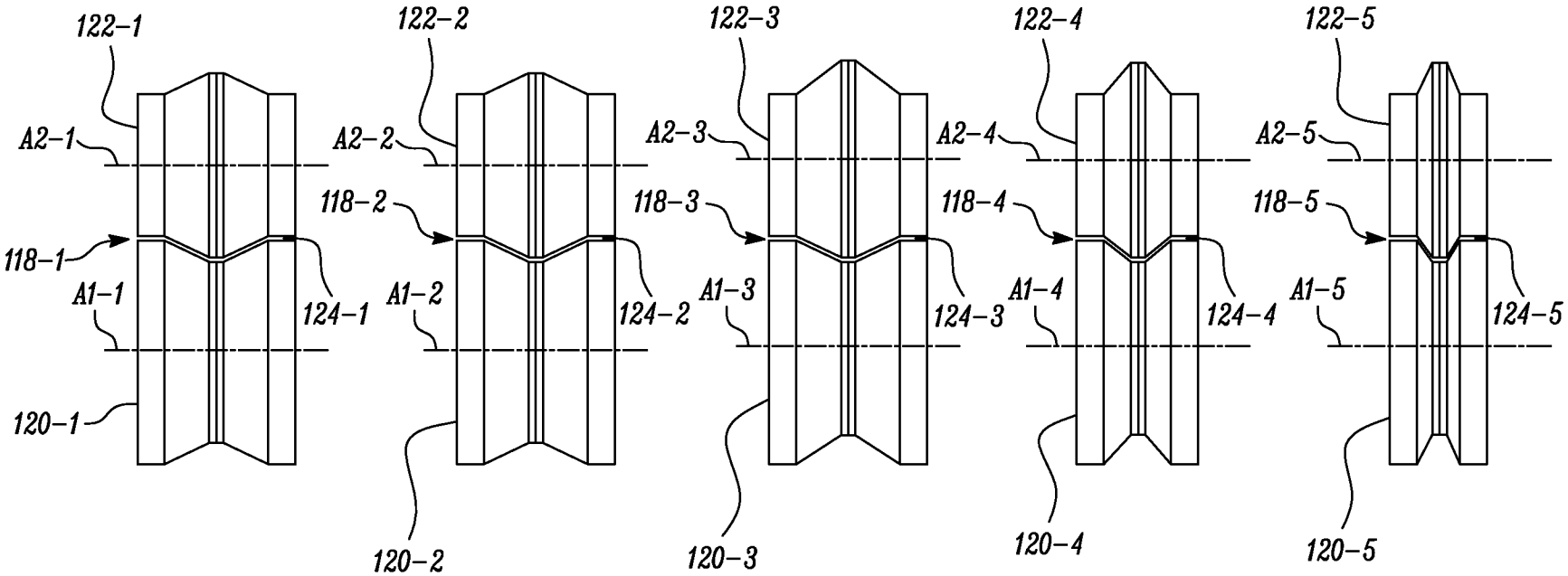
FIG. 3A is a schematic view of a first forming roller set associated with the system of FIG. 2A according to the present disclosure.
FIG. 3B is a schematic view of a first intermediate forming roller set associated with the system of FIG. 2A according to the present disclosure.
FIG. 3C is a schematic view of a second intermediate forming roller set associated with the system of FIG. 2A according to the present disclosure.
FIG. 3D is a schematic view of a third intermediate forming roller associated with the system of FIG. 2A according to the present disclosure.
FIG. 3E is a schematic view of a final forming roller set associated with the system of FIG. 2A according to the present disclosure.

As shown in FIG. 3A, the first forming roller set profile 118-1 may be defined in the space 124-1 between the first inner and outer forming rollers 120-1, 122-1. As shown in FIG. 3B, the second forming roller set profile 118-2 may be defined in the space 124-2 between the second inner and outer forming rollers 120-2, 122-2. As shown in FIG. 3C, the third forming roller set profile 118-3 may be defined in the space 124-3 between the third inner and outer forming rollers 120-3, 122-3. As shown in FIG. 3D, the fourth forming roller set profile 118-4 may be defined in the space 124-4 between the fourth inner and outer forming rollers 120-4, 122-4. As shown in FIG. 3E, the fifth forming roller set profile 118-5 may be defined in the space 124-5 between the fifth inner and outer forming rollers 120-5, 122-5.

Further, the forming roller set profiles 118-1, 118-2, 118-3, 118-4, 118-5 (see 3A, 3B, 3C, 3D, 3E, respectively) of at least two forming roller sets 106-1, 106-2, 106-3, 106-4, 106-5 (see FIG. 2A) are different from each other. In some examples, the forming roller set profiles 118-1, 118-2, 118-3, 118-4, 118-5 of the plurality of forming roller sets 106 (see FIG. 2A) may all be different from each other.

Figure 4:
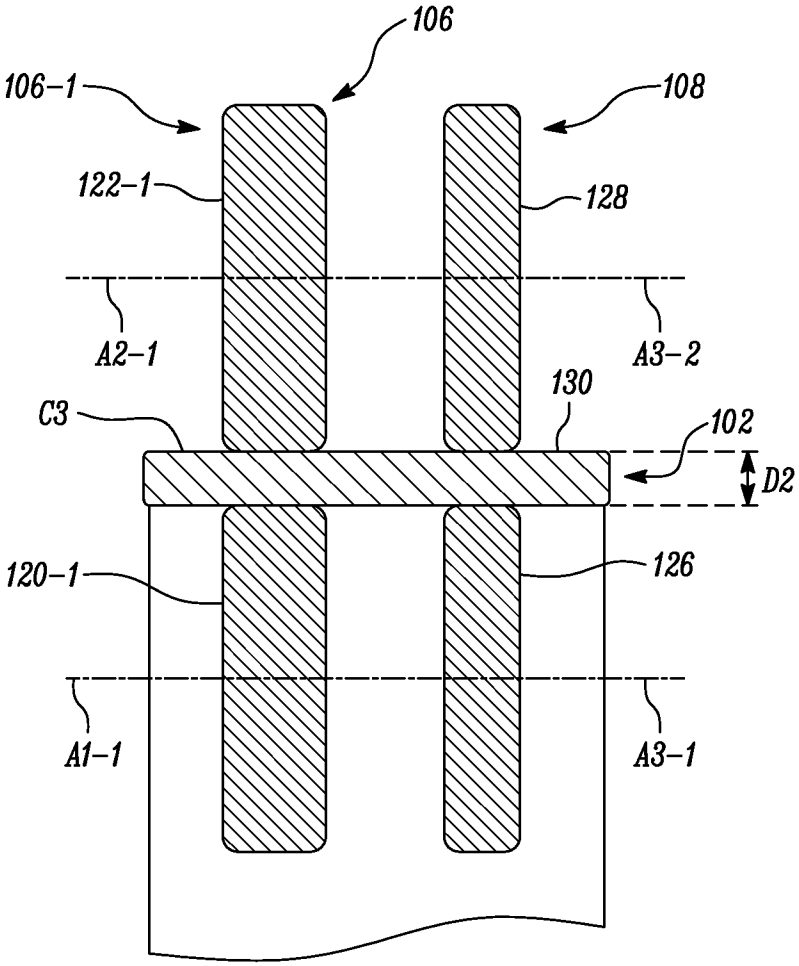
FIG. 4 is a sectional schematic view of the first forming roller set and a non-forming roller set associated with the system of FIG. 2A according to the present disclosure.

Referring to FIG. 4, the system 100 may further include the one or more non-forming roller sets 108 configured to selectively engage with and disengage from the ring component 102. The non-forming roller set 108 may be disposed adjacent to a corresponding forming roller set 106-1, 106-2, 106-3, 106-4, 106-5 (see FIG. 2A), or between forming roller sets. For explanatory purposes, only the non-forming roller set 108 disposed adjacent to the first forming roller set 106-1 is illustrated in FIG. 4. However, it should be noted that other forming roller sets 106-2, 106-3, 106-4, 106-5 of the system 100 may also include a corresponding non-forming roller set 108. Equally, or instead, one or more non-forming roller sets 108 may be included in isolation, i.e. not adjacent to any of the forming rollers sets 106.

As illustrated in FIG. 4, the non-forming roller set 108 includes an inner non-forming roller 126 and an outer non-forming roller 128. Although, only two non-forming rollers 126, 128 are illustrated in FIG. 4, it may be contemplated that the non-forming roller set 108 may include more than two non-forming rollers. Further, the inner non-forming roller 126 rotates about an inner non-forming roller axis A3-1 and the outer non-forming roller 128 rotates about an outer non-forming roller axis A3-2.

In some examples, the inner non-forming roller axis A3-1 may coincide with the inner forming roller axis A1-1 and the outer non-forming roller axis A3-2 may coincide with the outer forming roller axis A2-1. In other examples, the inner non-forming roller axis A3-1 may be spaced apart from the inner forming roller axis A1-1 and the outer non-forming roller axis A3-2 may be spaced apart from the outer forming roller axis A2-1. Further, a distance D2 may be defined between the inner forming roller 126 and the outer forming roller 128. The distance between the axes will be determined by the diameters of the forming and non-forming roller sets, and the need for the non-forming roller set(s) to grip the ring component 102 such as to maintain tension in the ring component 102 at locations where or times when the ring component is not under tension from one or more of the forming roller sets. In some examples, an engagement and a disengagement of the one or more non-forming roller sets 108 with the ring component 102 may include changing the distance D2 between the inner non-forming roller 126 and the outer non-forming roller 128 of the non-forming roller set 108.

Figure 5:
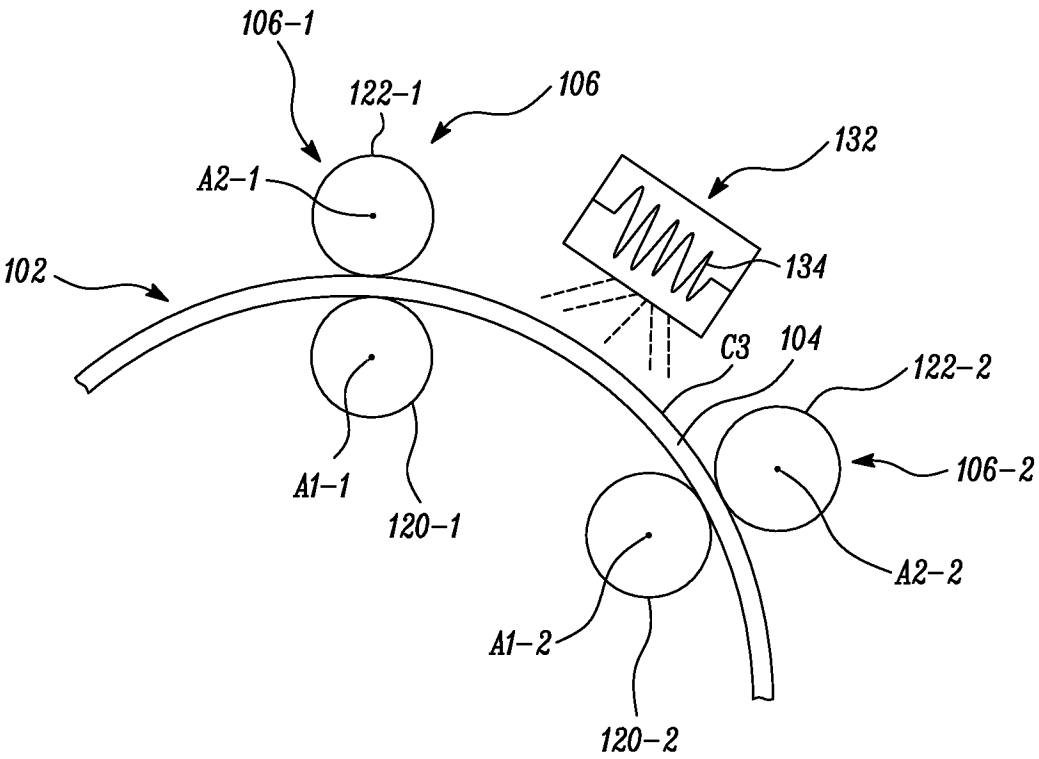
FIG. 5 is a schematic view illustrating a heating element associated with the system of FIG. 2A according to the present disclosure.

Referring to the example of FIG. 5, the system 100 may further include a heating element 132. In FIG. 5 the heating element is shown disposed between the two forming roller sets 106-1 and 106-2 from the plurality of forming roller sets 106. The heating element 132 may be disposed circumferentially around the ring component 102. Although a single heating element 132 disposed between the first forming roller set 106-1 and the first intermediate roller set 106-2 is illustrated in the example of FIG. 5, the system 100 may include multiple heating elements adjacent to or around other forming roller sets 106 within the system. For example, the heating element 132 may be disposed between the first intermediate forming roller set 106-2 and the second intermediate forming roller set 106-3 (see FIG. 2A), the second intermediate forming roller set 106-3 and the third intermediate forming roller set 106-4 (see FIG. 2A), the third intermediate forming roller set 106-4 and the final forming roller set 106-5 (see FIG. 2A), and/or the final forming roller set 106-5 and the first forming roller set 106-1. The heating element 132 may be configured to locally heat a portion of the ring component 102 just in front of or disposed between the at least two forming roller sets 106-1, 106-2, 106-3, 106-4, 106-5. In the illustrated example of FIG. 5, the heating element 132 may locally heat a portion of the ring component 102 just in front of or disposed between the first forming roller set 106-1 and the first intermediate forming roller set 106-2. In some examples, the heating of the ring component 102 using the heating element 132 may improve material formability. Further, the system 100 including the heating element 132 may be used to manufacture ring components 102 having higher ductility at increased temperatures.

It should be noted that the heating element 132 may include various types of suitable heating source, as will be apparent to the skilled person. In some examples, the heating element 132 may include a heating coil 134. The heating element 132 may include an electric heating element, a laser, and the like. In some examples, the heating element 132 may include conventional resistance heating elements, such as, a heat gun set-up, or an in-line oven to heat the ring component 102. The heating element could comprise a container of heated gas or plasma positioned around the ring component, either in isolation or in conjunction with at least one forming roller set. The heating element could be internal to the forming roller set, within the inner forming roller 120, outer forming roller 122, or both, so as to heat the ring component as it passes between the rollers 120, 122 of the forming roller set. Each heating element 132 is designed in such a way that it can locally heat the ring component 102 prior to, or as it undergoes deformation by the one or more forming roller sets. The heating element 132 may further eliminate or reduce a requirement of performing interstage annealing.

Further, a heating element 132 can introduce a temperature gradient in the ring component 102 in a vicinity of the forming roller sets 106. Such a temperature gradient may allow for both a cold forming process and a hot forming process to be performed simultaneously on the ring component 102. Further, the hot forming process may increase the formability of the ring component 102 and the cold forming process may produce tighter tolerances. Additionally, usage of a heating element 132 may allow for an increase in the thickness of the ring component 102 which can be formed using the system 100.

FIGS. 6A to 6D illustrate schematic views of the plurality of forming roller sets 106 of the example system configuration in the engagement configuration. For clarity purposes, only the ring component 102 and the plurality of forming roller sets 106 are illustrated in FIGS. 6A to 6D. The actuating unit 110 (see FIG. 1) is operably coupled to the plurality of forming roller sets 106. The actuating unit 110 (see FIG. 1) is operably coupled to the one or more non-forming roller sets 108 (see FIG. 4).

In an example, the actuating unit 110 may include a number of actuators, such as, hydraulic actuators or pneumatic actuators. In some examples, each inner forming roller 120 (see FIG. 2B) may include a corresponding inner actuator (not shown) and each outer forming roller 122 (see FIG. 2C) may include a corresponding outer actuator (not shown), without any limitations. In some examples, the actuating unit 110 may include various position sensors (not shown) that may generate signals corresponding to a position of the inner and outer actuators. The position sensors may be in communication with the controller 112 (see FIG. 1) for precise control of the movement of the inner and outer actuators. In an example, the actuating unit 110 may include an electric solenoid. It should be noted that the actuating unit 110 may include any arrangement of components that may facilitate the engagement and the disengagement of the plurality of forming roller sets 106 and the non-forming roller sets 108.

The actuating unit 110 is configured to control a configuration of the inner forming rollers 120-1, 120-2, 120-3, 120-4, 120-5 and the outer forming rollers 122-1, 122-2, 122-3, 122-4, 122-5 of the plurality of forming roller sets 106 so as to control a timing of the engagement and the disengagement of the plurality of forming roller sets 106 with the ring component 102. The engagement and the disengagement of the plurality of forming roller sets 106 with the ring component 102 may include changing the distance D1-1, D1-2, D1-3, D1-4, D1-5 of the forming roller sets 106-1, 106-2, 106-3, 106-4, 106-5 with the ring component 102. The actuating unit 110 may be configured to control the engagement and the disengagement of each forming roller set 106 by changing the respective distance D1-1, D1-2, D1-3, D1-4, D1-5 between the inner forming roller 120 and the outer forming roller 122 of the respective forming roller set 106-1, 106-2, 106-3, 106-4, 106-5. Specifically, the distance D1-1, D1-2, D1-3, D1-4, D1-5 defined by the corresponding forming roller set 106-1, 106-2, 106-3, 106-4, 106-5 will decrease when the corresponding forming roller set 106-1, 106-2, 106-3, 106-4, 106-5 is engaged with the ring component 102. Further, the distance D1-1, D1-2, D1-3, D1-4, D1-5 defined by the corresponding forming roller set 106-1, 106-2, 106-3, 106-4, 106-5 will increase when the corresponding forming roller set 106-1, 106-2, 106-3, 106-4, 106-5 is disengaged from the ring component 102.

It should be noted that an amount by which each of the plurality of forming roller sets 106 may have to be moved for changing the corresponding distance D1-1, D1-2, D1-3, D1-4, D1-5 may be prestored within a memory associated with the controller 112. In some examples, the amount by which each of the plurality of forming roller sets 106 may have to be moved may be based on the profile 130 to be formed on the ring component 102. It should be noted that the controller 112 may transmit the control signals to the actuating unit 110, which may in turn move the inner forming rollers 120-1, 120-2, 120-3, 120-4, 120-5 and the outer forming rollers 122-1, 122-2, 122-3, 122-4, 122-5 for changing the respective distances D1-1, D1-2, D1-3, D1-4, D1-5.

The actuating unit 110 is further configured to engage each of the forming roller sets 106-1, 106-2, 106-3, 106-4, 106-5 so as to form each forming roller set profile 118-1, 118-2, 118-3, 118-4, 118-5 (see FIGS. 3A to 3E) on at least 360 degrees of the ring component 102. Further, the timing of the engagement of each forming roller set 106 with the ring component 102 is staggered with respect to each of the other forming roller sets 106-1, 106-2, 106-3, 106-4, 106-5. For example, each of the plurality of forming roller sets 106 may be engaged at different instances of time, as per application requirements. The timing at which each of the plurality of forming roller sets 106 may engage with the ring component 102 may vary based on factors, such as, the material of the ring component 102, dimensions of the ring component 102, the profile 130 to be formed on the ring component 102, a total number of the plurality of forming roller sets 106, and the like.

Further, in the illustrated example of FIG. 6A, the ring component 102 is rotated in a clockwise direction R1 about the system axis A0 for engaging each of the plurality of forming roller sets 106 with the ring component 102. Alternatively, the ring component 102 may be rotated in a counter-clockwise direction R2 (shown in FIG. 2A) about the system axis A0 for engaging each of the plurality of forming roller sets 106 with the ring component 102. Further, based on the engagement of the forming roller sets 106-1, 106-2, 106-3, 106-4, 106-5 with the ring component 102, the forming roller sets 106-1, 106-2, 106-3, 106-4, 106-5 may exert a force on the ring component 102 which may in turn lead to the formation of the profile 130 on the ring component 102. The force to be applied on the ring component 102 may be decided based on one or more factors, such as, the profile 130 to be formed on the ring component 102, the material of the ring component 102, dimensions of the ring component 102, and other factors which will be apparent to the person skilled in the art.

Referring to FIG. 6A, the first forming roller set 106-1 is shown in the engagement configuration. The actuating unit 110 (see FIG. 1) is configured to engage the first forming roller set 106-1 with the ring component 102 while other forming roller sets 106-2, 106-3, 106-4, 106-5 from the plurality of forming roller sets 106 are disengaged from the ring component 102. Specifically, the actuating unit 110 may engage the first forming roller set 106-1 with the ring component 102 while the first intermediate forming roller set 106-2, the second intermediate forming roller set 106-3, the third intermediate forming roller set 106-4, and the final forming roller set 106-5 are disengaged from the ring component 102. When the first forming roller set 106-1 engages with the ring component 102, the first forming roller set profile 118-1 (see FIG. 3A) is formed on a first section 136 of the ring component 102.

Further, the actuating unit 110 may be further configured to engage the one or more intermediate forming roller sets 106-2, 106-3, 106-4 with the ring component 102 one after the other while the first forming roller set 106-1 is engaged with the ring component 102. In the illustrated example of FIG. 6A, the actuating unit 110 is configured to engage the next intermediate forming roller set 106-2 in circumferential order with the ring component 102 after a portion 136-1 of the ring component 102 formed with the forming roller set profile 118-1 of the previous adjacent forming roller set 106-1 passes the next intermediate forming roller set 106-2. In this way, a sequence of rolling former set profiles is formed on the ring component as it is rotated around the device 100. For ease of understanding, a legend is illustrated in FIG. 6A depicting the first section 136 and the portion 136-1.

Next, the actuating unit 110 engages the first intermediate forming roller set 106-2 with the ring component 102 while the first forming roller set 106-1 is still engaged with the ring component 102, and the second intermediate forming roller set 106-3, the third intermediate forming roller set 106-4, and the final forming roller set 106-5 are disengaged from the ring component 102. The actuating unit 110 engages the first intermediate forming roller set 106-2 with the ring component 102 after at least the portion 136-1 of the ring component 102 formed by the first forming roller set 106-1 passes the first intermediate forming roller set 106-2. Alternatively, the actuating unit 110 may engage the first intermediate forming roller set 106-2 with the ring component 102 after the first forming roller set profile 118-1 is defined on the whole circumference C3 of the ring component 102. In this alternative case, the first forming roller set 106-1 shall then be disengaged from the ring component 102 before the section of the ring component 102 having the first intermediate forming roller set profile 118-2 arrives back at the first forming roller set 106-1, so as to prevent the first forming roller set profile 118-1 being reformed on the ring component.

Referring to FIG. 6B, when the first intermediate forming roller set 106-2 engages with the ring component 102, the first intermediate forming roller set profile 118-2 (see FIG. 3B) is formed on a second section 138 of the ring component 102. Further, the actuating unit 110 (see FIG. 1) may engage the second intermediate forming roller set 106-3 with the ring component 102 while the first forming roller set 106-1 and the first intermediate forming roller set 106-2 are engaged with the ring component 102 and the third intermediate forming roller set 106-4 and the final forming roller set 106-5 may be disengaged from the ring component 102. The actuating unit 110 will engage the second intermediate forming roller set 106-3 with the ring component 102 after at least a portion 138-1 of the second section 138 of the ring component 102 formed by the first intermediate forming roller set 106-2 passes the second intermediate forming roller set 106-3. Alternatively, the actuating unit 110 may engage the second intermediate forming roller set 106-3 with the ring component 102 after the first intermediate forming roller set profile 118-2 (see FIG. 3B) is defined on the whole circumference C3 of the ring component 102. In this alternative case, the second forming roller set 106-2 shall then be disengaged from the ring component 102 before the section of the ring component 102 having the second intermediate forming roller set profile 118-3 arrives back at the first intermediate forming roller set 106-2, so as to prevent the first intermediate forming roller set profile 118-2 being reformed on the ring component.

As shown in FIG. 6C, when the second intermediate forming roller set 106-3 engages with the ring component 102, the second intermediate roller set profile 118-3 (see FIG. 3C) is formed on a third section 140 of the ring component 102. For ease of understanding, a legend is illustrated in FIG. 6B depicting the first section 136, the portion 136-1, the second section 138, and the portion 138-1. Further, the actuating unit 110 (see FIG. 1) can engage the third intermediate forming roller set 106-4 with the ring component 102 while the first forming roller set 106-1, the first intermediate forming roller set 106-2, and the second intermediate forming roller set 106-3 are engaged with the ring component 102 and the final forming roller set 106-5 is disengaged from the ring component 102. The actuating unit 110 can engage the third intermediate forming roller set 106-4 with the ring component 102 after at least a portion 140-1 of the third section 140 of the ring component 102 formed by the second intermediate forming roller set 106-3 passes the third intermediate forming roller set 106-4. For ease of understanding, a legend is illustrated in FIG. 6C depicting the first section 136, the portion 136-1, the second section 138, the portion 138-1, the third section 140, and the portion 140-1.

Alternatively, the actuating unit 110 may engage the third intermediate forming roller set 106-4 with the ring component 102 after the second intermediate forming roller set profile 118-3 (see FIG. 3C) is defined on the whole circumference C3 of the ring component 102. In this alternative case, the second intermediate forming roller set 106-3 shall then be disengaged from the ring component 102 before the section of the ring component 102 having the third intermediate forming roller set profile 118-4 arrives back at the second intermediate forming roller set 106-3, so as to prevent the second forming roller set profile 118-3 being reformed on the ring component.

As shown in FIG. 6D, when the third intermediate forming roller set 106-4 engages with the ring component 102, the fourth forming roller set profile 118-4 (see FIG. 3D) is formed on a fourth section 142 of the ring component 102. Further, the actuating unit 110 (see FIG. 1) may be further configured to engage the final forming roller set 106-5 with the ring component 102 while the first forming roller set 106-1 and the one or more intermediate forming roller sets 106-2, 106-3, 106-4 may be engaged with the ring component 102. The actuating unit 110 may be further configured to engage the final forming roller set 106-5 with the ring component 102 after a portion 142-1 of the ring component 102 formed with the intermediate forming roller set profile 118-4 (see FIG. 3D) of the adjacent intermediate forming roller set 106-4 passes the final forming roller set 106-5. Further, the actuating unit 110 may engage the final forming roller set 106-5 with the ring component 102 after at least the portion 142-1 of the fourth section 142 of the ring component 102 formed by the third intermediate forming roller set 106-4 passes the final forming roller set 106-5. For ease of understanding, a legend is illustrated in FIG. 6D depicting the first section 136, the portion 136-1, the second section 138, the portion 138-1, the third section 140, the portion 140-1, the fourth section 142, and the portion 142-1.

Alternatively, the actuating unit 110 may engage the final forming roller set 106-5 with the ring component 102 after the third intermediate forming roller set profile 118-4 (see FIG. 3D) is defined on the whole circumference C3 of the ring component 102. When the final forming roller set 106-5 engages with the ring component 102, the final forming roller set profile 118-5 (see FIG. 3E) will be formed on a fifth section 144 (see FIG. 7A to 7E) of the ring component 102. In this alternative case, the third intermediate forming roller set 106-4 shall then be disengaged from the ring component 102 before the section of the ring component 102 having the fourth intermediate forming roller set profile 118-5 arrives back at the third intermediate forming roller set 106-4, so as to prevent the third forming roller set profile 118-3 being reformed on the ring component.

The actuating unit 110 may be further configured to engage the one or more non-forming roller sets 108 (see FIG. 4) with the ring component 102 at least while at least one of the forming roller sets 106-1, 106-2, 106-3, 106-4, 106-5 from the plurality of forming roller sets 106 is engaged with the ring component 102. For example, the non-forming roller set 108 (see FIG. 4) may be engaged with the ring component 102 when the first forming roller set 106-1 is engaged with the ring component 102. Alternatively, non-forming roller sets may be engaged with the ring component in regions where the forming roller sets are disengaged with the ring component so as to maintain circumferential tension in the ring component in regions which are not currently being formed.

FIGS. 7A to 7E illustrate schematic views of the plurality of forming roller sets 106 in the disengagement configuration. For clarity purposes, only the ring component 102 and the plurality of forming roller sets 106 are illustrated in FIGS. 7A to 7E. As illustrated in FIGS. 7A to 7E, the actuating unit 110 (see FIG. 1) may be further configured to disengage each forming roller set 106 from the ring component 102 after at least the whole circumference C3 of the ring component 102 has been formed with the corresponding forming roller set 106-1, 106-2, 106-3, 106-4, 106-5. As explained earlier, this means that each part of the ring component will have been formed by each forming roller set before the forming roller set disengages. It does not mean that the whole of the ring component must be formed by a particular forming roller set before the next forming roller set can engage with the ring component, although this is also an option.

Figure 7A:
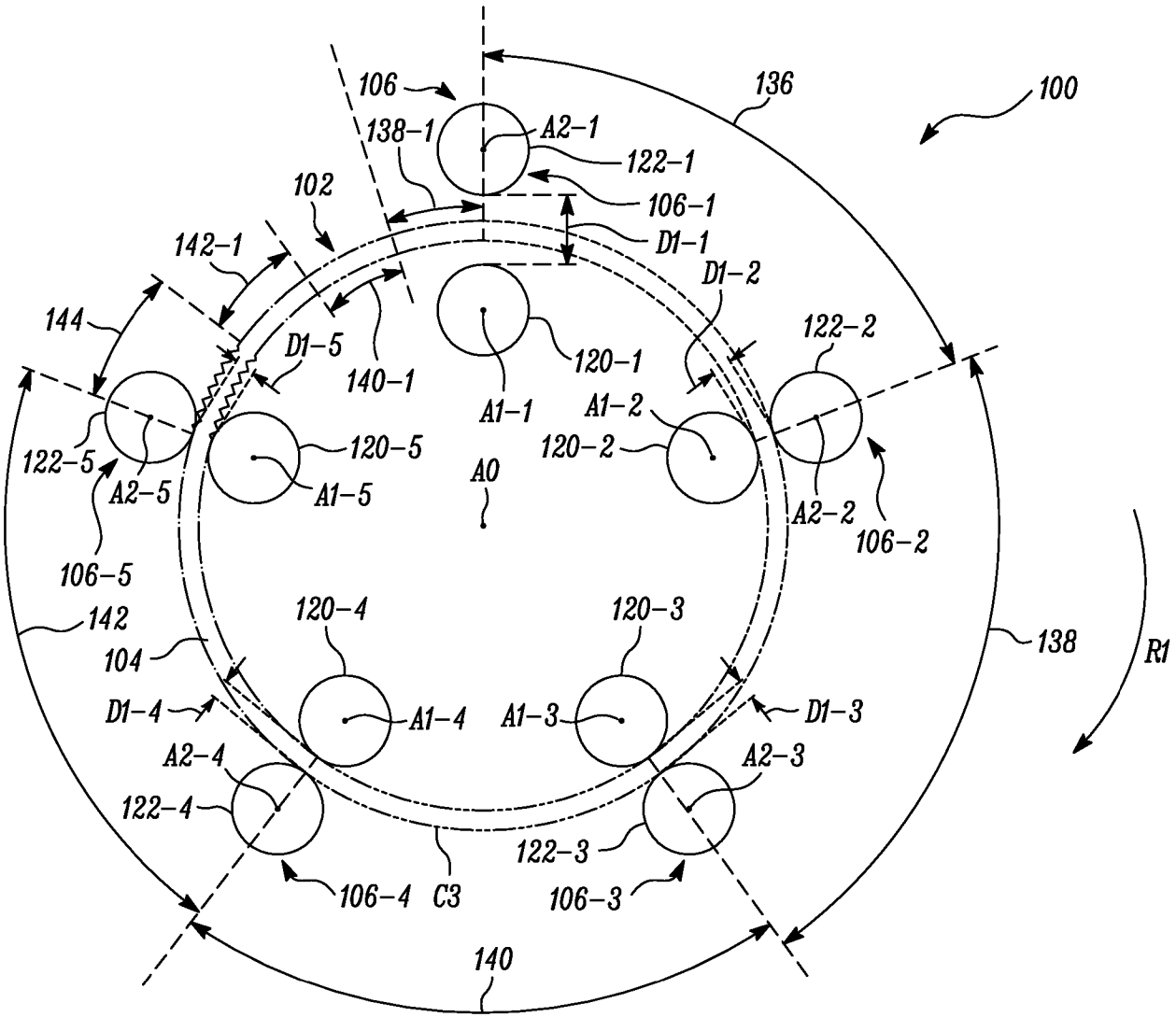
FIG. 7A is a schematic view illustrating the first forming roller set disengaged from the ring component of FIG. 2A.

FIGS. 7A, 7B, 7C, 7D and 7E show how the forming roller sets 106 of the present example configuration may be disengaged in sequence such that the ring component can be pressed into its final contour without the need for multiple rotations of the ring component 102 around the device 100. FIG. 7A shows the situation where the final contouring (in this example, final forming roller set profile 118-5) has been pressed onto the fifth section 144 (indicated by the zig-zag line) of the ring component 102. The fourth section 142 (indicated by the dot-dashed lines) is currently contoured as per the profile of the previous forming roller set (in this example third intermediate forming roller set profile 118-4), the third section 140 (indicated by the long dash double short dashed lines) is contoured as per the profile of the forming roller set previous to that (in this example second intermediate forming roller set profile 118-3), the second section 138 (indicated by the long dash short dashed lines) is contoured as per the profile of the forming roller set previous to that (in this example first intermediate forming roller set profile 118-2), and the first section 136 (indicated by the dashed lines) is contoured as per the profile of the first forming roller set (in this example the first forming roller set profile 118-1).

In FIG. 7B, the ring component 102 continues to be rotated by the device 100. The fifth section 144 passes through the gap between the rollers of the disengaged first forming roller set 106-1, heading towards the first intermediate forming roller set 106-2. As the first intermediate forming roller set has now imparted the first intermediate forming roller set profile 118-2 to the entire ring, it can disengage in preparation for the arrival of the fifth section 144 of the ring component which has the final profile.

Figure 7C:
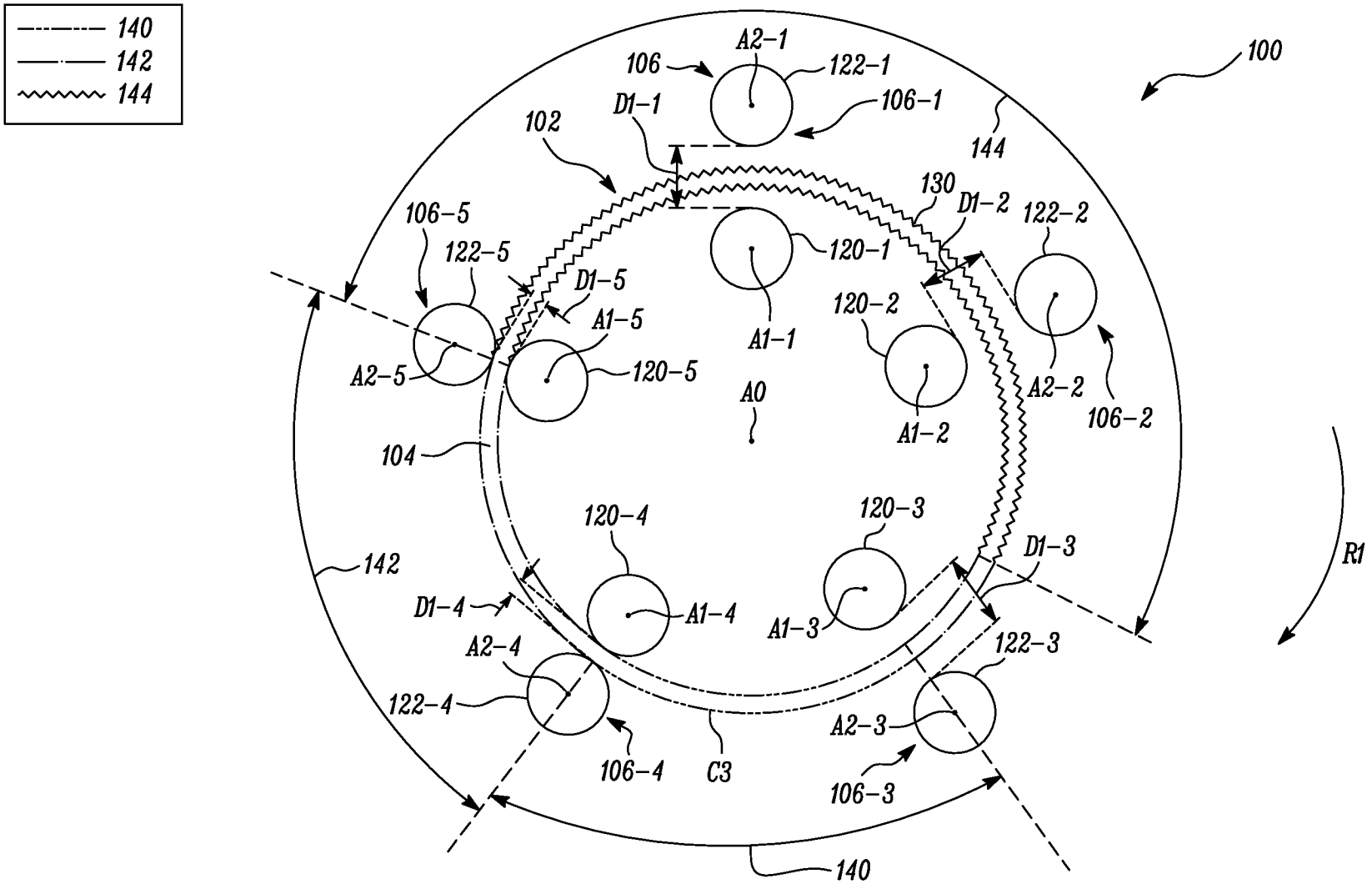
FIG. 7C is a schematic view illustrating the second intermediate forming roller set disengaged from the ring component of FIG. 2A.

FIG. 7C shows a similar situation with regards to the second intermediate forming roller set 106-3, which, having imparted the second intermediate forming roller set profile 118-3 to the entire ring, it can disengage in preparation for the arrival of the fifth section 144 of the ring component which has the final profile.

Figure 7D:
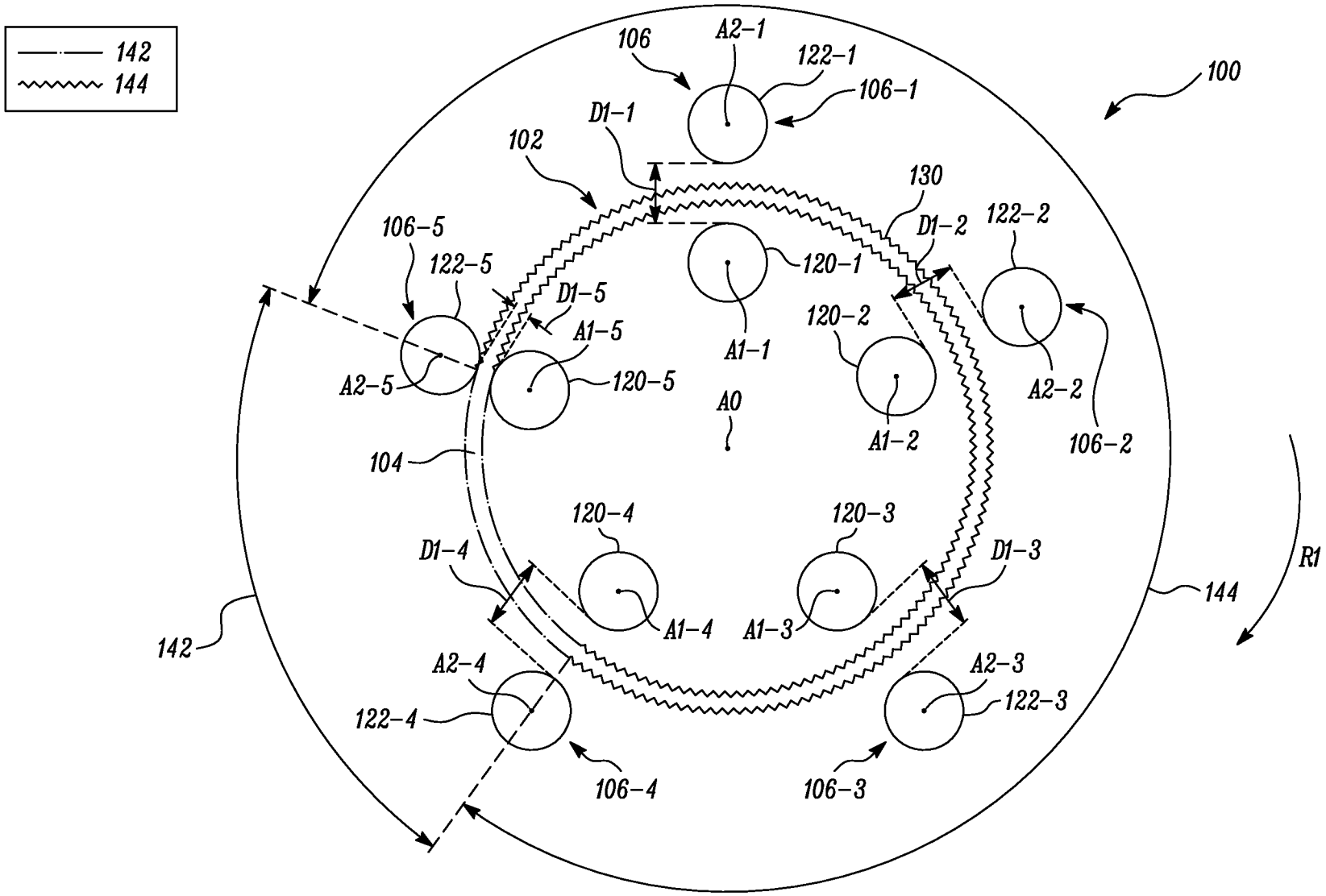
FIG. 7D is a schematic view illustrating the third intermediate forming roller set disengaged from the ring component of FIG. 2A.

Similarly, FIG. 7D shows the configuration after the third intermediate forming roller set 106-4, which, having imparted the third intermediate forming roller set profile 118-3 to the entire ring, it can disengage before the arrival of the fifth section 144 of the ring component which has the final profile.

Figure 7E:
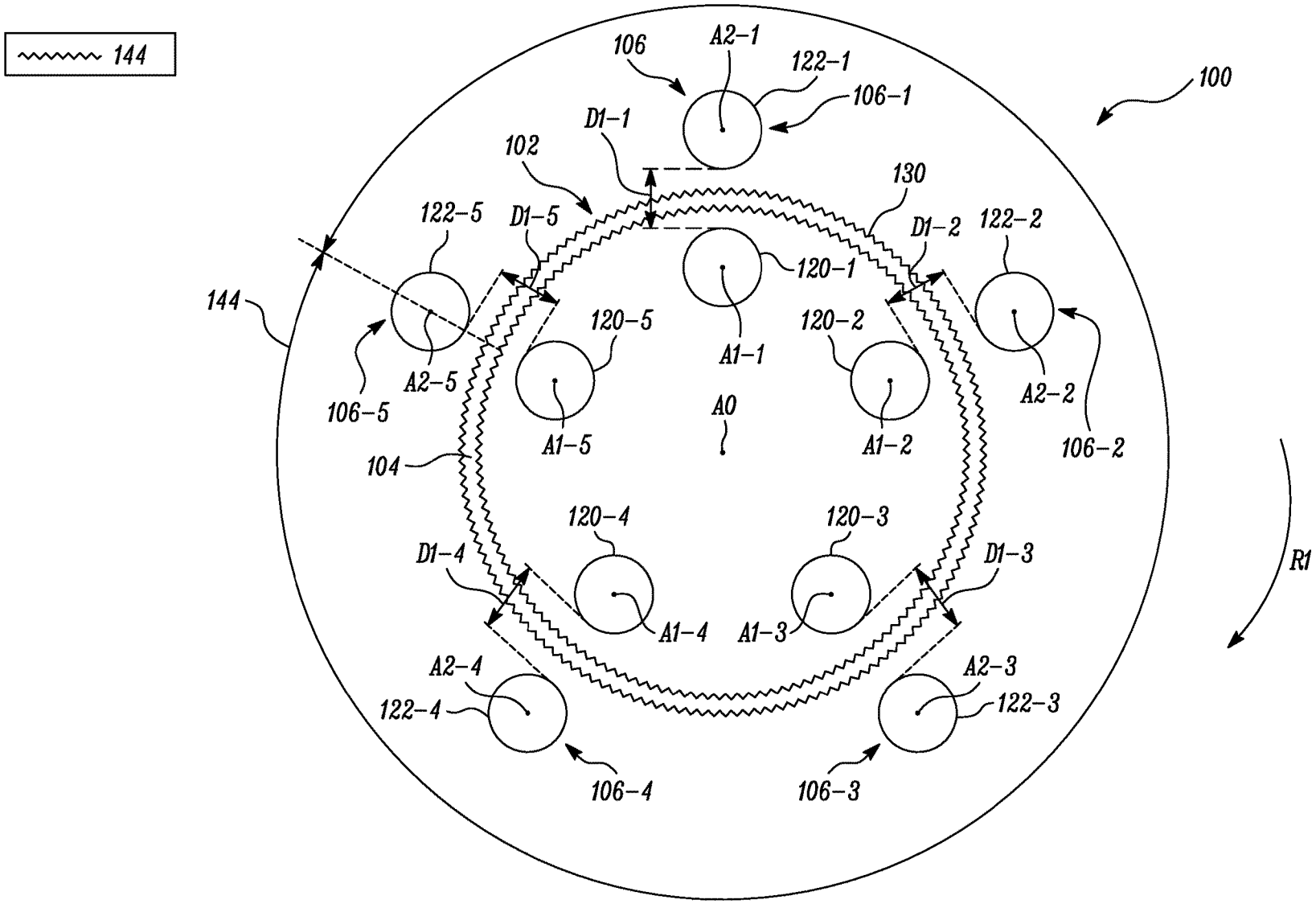
FIG. 7E is a schematic view illustrating the final forming roller set disengaged from the ring component of FIG. 2A.

Finally, FIG. 7E shows the configuration after the fourth intermediate forming roller set 106-5, which, having imparted the final forming roller set profile 118-5 to the entire ring, it can disengage from the ring component, ready for the ring component to be removed from the system 100.

It will of course be understood that the same principle of operation will apply to systems having greater or fewer intermediate forming roller sets than the three shown in the present example.

As an alternative, each forming roller set 106 may be engaged individually for an entire rotation of the ring component so as to contour the entire ring component according to its forming roller set profile 118, then disengaged when the next forming roller set in engaged, and so on.

Figure 8:
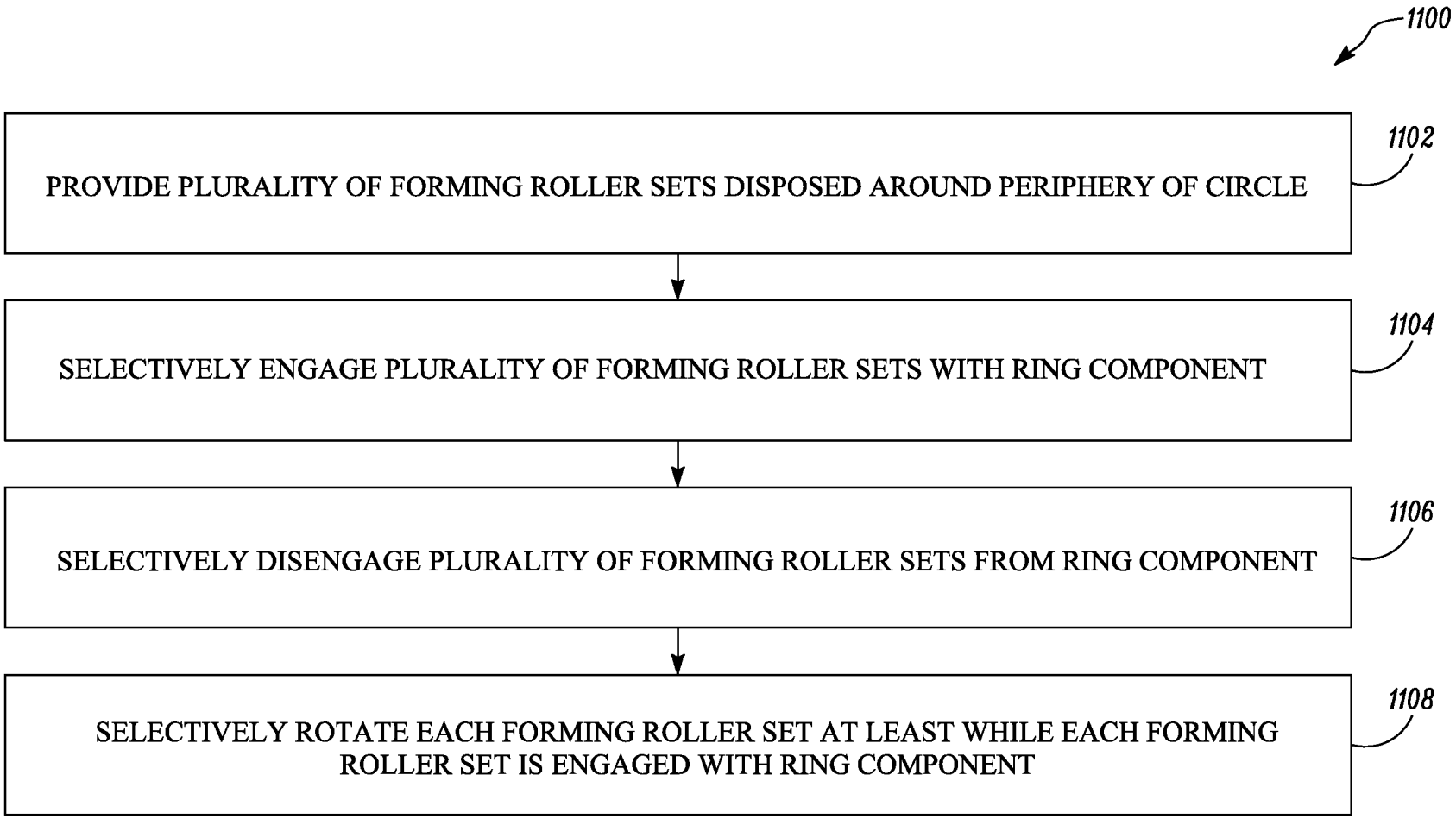
FIG. 8 is a flowchart of a method for contouring the ring component according to the present disclosure.

FIG. 8 illustrates a flowchart of an example method 1100 for contouring the ring component 102. Different steps of the method 1100 can be implemented using the system 100 shown in FIG. 1. Referring to FIGS. 1 to 8, at step 1102, the plurality of forming roller sets 106 are disposed around the periphery of the circles C1, C2. The circles C1, C2 are centred on the system axis A0. Each of the plurality of forming roller sets 106 includes the inner forming roller 120 and the outer forming roller 122. The one or more intermediate forming roller sets 106-2, 106-3, 106-4 from the plurality of forming roller sets 106 are circumferentially disposed between the first forming roller set 106-1 and the final forming roller set 106-5. The inner forming rollers 120 are configured to rotate about their respective inner forming roller axes A2-1, A2-2, A2-3, A2-4, A2-5. Further, the outer forming rollers 122 are configured to rotate about their respective outer forming roller axes A1-1, A1-2, A1-3, A1-4, A1-5. The inner forming roller axes A1-1, A1-2, A1-3, A1-4, A1-5 are closer to the system axis A0 than the outer forming roller axes A2-1, A2-2, A2-3, A2-4, A2-5. The inner forming rollers 120 and the outer forming rollers 122 are adjustable between at least an engagement configuration and a disengagement configuration. Further, when in the engagement configuration, the inner forming rollers 120 and the outer forming rollers 122 define in the respective space 124-1, 124-2, 124-3, 124-4, 124-5 therebetween the respective forming roller set profiles 118-1, 118-2, 118-3, 118-4, 118-5, such that, upon the engagement with the ring component 102, each forming roller set 106 is configured to form the profile 130 on the ring component 102 based on the respective forming roller set profile 118-1, 118-2, 118-3, 118-4, 118-5 of the respective forming roller set 106-1, 106-2, 106-3, 106-4, 106-5. Additionally, the forming roller set profiles 118-1, 118-2, 118-3, 118-4, 118-5 of at least two forming roller sets 106-1, 106-2, 106-3, 106-4, 106-5 are different from each other. The plurality of forming roller sets 106 are movably mounted to the frame 114.

At step 1104, the plurality of forming roller sets 106 are selectively engaged with the ring component 102. The step 1104 of selectively engaging each forming roller set 106 further includes changing the distances D1-1, D1-2, D1-3, D1-4, D1-5 between the inner forming rollers 120 and the outer forming rollers 122 of the respective forming roller sets 106-1, 106-2, 106-3, 106-4, 106-5. Further, the first forming roller set 106-1 from the plurality of forming roller sets 106 may be engaged with the ring component 102 while other forming roller sets 106-2, 106-3, 106-4, 106-5 from the plurality of forming roller sets 106 are disengaged from the ring component 102. The first forming roller set 106-1 includes the first forming roller set profile 118-1. Further, the one or more intermediate forming roller sets 106-2, 106-3, 106-4 from the plurality of forming roller sets 106 may be engaged with the ring component 102 one after the other while the first forming roller set 106-1 is engaged with the ring component 102. Each intermediate forming roller set 106-2, 106-3, 106-4 comprises its respective intermediate forming roller set profile 118-2, 118-3, 118-4. Moreover, engaging the one or more intermediate forming roller sets 106-2, 106-3, 106-4 with the ring component 102 comprises engaging the at least one intermediate forming roller set 106-2, 106-3, 106-4 with the ring component 102 after the portion 136-1 of the ring component 102 formed with the forming roller set profile 118-1 of a previous adjacent forming roller set 106-1 passes the at least one intermediate forming roller set 106-2, 106-3, 106-4.

Additionally, the final forming roller set 106-5 from the plurality of forming roller sets 106 may be engaged with the ring component 102 while the first forming roller set 106-1 and the one or more intermediate forming roller sets 106-2, 106-3, 106-4 may be engaged with the ring component 102. The final forming roller set 106-5 comprises the final forming roller set profile 118-5. Additionally, engaging the final forming roller set 106-5 with the ring component 102 includes engaging the final forming roller set 106-5 with the ring component 102 after the portion 142-1 of the ring component 102 formed with the intermediate forming roller set profile 118-4 of an adjacent intermediate forming roller set 106-4 passes the final forming roller set 106-5.

Moreover, one or more non-forming roller sets 108 may be selectively engaged with the ring component 102 at least while at least one forming roller set 106-1, 106-2, 106-3, 106-4, 106-5 from the plurality of forming roller sets 106 may be engaged with the ring component 102. The plurality of forming roller sets 106 may be selectively engaged with the ring component 102 such that the ring component 102 may be constrained and does not spring back during contouring.

At step 1106, the plurality of forming roller sets 106 are selectively disengaged from the ring component 102. Further, each roller set 106 may be disengaged at least after the whole circumference C3 of the ring component 102 may be formed with the corresponding forming roller set 106-1, 106-2, 106-3, 106-4, 106-5. The step 1106 of selectively disengaging each forming roller set 106 may further include changing the distance D1-1, D1-2, D1-3, D1-4, D1-5 between the inner forming rollers 120 and the outer forming rollers 122 of the respective forming roller sets 106-1, 106-2, 106-3, 106-4, 106-5. Further, the first forming roller set 106-1 may be disengaged from the ring component 102 while the final forming roller set 106-5 and the one or more intermediate forming roller sets 106-2, 106-3, 106-4 may be engaged with the ring component 102. Moreover, the one or more intermediate forming roller sets 106-2, 106-3, 106-4 may be disengaged from the ring component 102 one after the other after the first forming roller set 106-1 has been disengaged from the ring component 102 and while the final forming roller set 106-5 is engaged with the ring component 102. The final forming roller set 106-5 is disengaged after the one or more intermediate forming roller sets 106-2, 106-3, 106-4 has been disengaged from the ring component 102.

At step 1108, each forming roller set 106 is selectively rotated at least while each forming roller set 106 is engaged with the ring component 102. Additionally, a portion of the ring component 102 disposed between at least two forming roller sets 106-1, 106-2, 106-3, 106-4, 106-5 from the plurality of forming roller sets 106 may be locally heated.

Thus, the present disclosure generally relates to the system 100 and the method 1100 for contouring the ring component 102. The system 100 and the method 1100 described herein addresses shortcomings presented by conventional forming processes. For example, it may be challenging to define complex and/or intricate profiles on various ring-shaped components using conventional contour roll forming process, due to limitations presented by a welding process. Specifically, a weld head may have limited access to the complex and/or intricate profiles for welding purposes. Further, in conventional vertical roll forming processes utilising only a single forming roller set, the ring-shaped component requires frequent removal and mounting upon a manufacturing set-up whilst the forming roller set is removed and replaced with a different forming roller set. This is time and labour-consuming, and therefore costly to the manufacturer. The method and device of the present disclosure overcomes these disadvantages of the prior art.

The system 100 for contouring the ring component 102 described herein provides improved cost-effectiveness and reduces the time required for manufacturing the ring component 102. Further, more complex and/or intricate profiles may be defined on the ring component 102 using the system 100 since the ring component 102 does not require welding after the formation of the profile 130. Thus, the system 100 may be used to manufacture ring components having different shapes.

Further, the system 100 and the method 1100 describe the engagement and the disengagement of each of the plurality of forming roller sets 106 at different intervals of time to ensure that the profile 130 is present on the whole circumference C3 of the ring component 102. Specifically, the actuating unit 110 may engage or disengage each of the plurality of forming roller sets 106 from the ring component 102 after each forming roller set profile 118-1, 118-2, 118-3, 118-4, 118-5 has been defined on the whole circumference C3 of the ring component 102. The technique of engaging a particular forming roller set 106-2, 106-3, 106-4, 106-5 after the portion 136-1, 138-1, 140-1, 142-1 of the ring component 102 is formed by a previous adjacent forming roller set 106-1, 106-2, 106-3, 106-4 provides for a gradual change in the shape of the profile 130 until the whole circumference C3 of the ring component 102 includes the profile 130. As such, abrupt changes in the shape of the ring component 102 during contouring of the ring component 102 are prevented. In some examples, the system 100 may optionally include the heating element 132 that may heat the ring component 102 during contouring of the ring component 102 to relieve internal stress, improve ductility, and improve formability of the ring component 102.

It will be understood that the disclosure is not limited to the examples above described and various modifications and improvements can be made without departing from the concepts described herein. Except where mutually exclusive, any of the features may be employed separately or in combination with any other features and the disclosure extends to and includes all combinations and sub-combinations of one or more features described herein.

We claim:

1. A system for contouring a ring component, the system comprising:

a frame;

a plurality of forming roller sets mounted to the frame;

each of the plurality of forming roller sets comprising an inner forming roller and an outer forming roller, the forming roller sets being arranged around a system axis such that, in use, the ring component passes between the inner forming roller and outer forming roller of each forming roller set;

wherein each inner forming roller is configured to rotate about its respective inner forming roller axis, and each the outer forming roller is configured to rotate about its respective outer forming roller axis, the inner forming roller axes being closer to the system axis than the outer forming roller axes, the inner forming rollers and the outer forming rollers being adjustable between at least an engagement configuration and a disengagement configuration, wherein, when in the engagement configuration, the inner forming roller and the outer forming roller of each forming roller set define in a space therebetween a forming roller set profile, such that, upon an engagement with the ring component, each forming roller set is configured to form a profile on the ring component based on the forming roller set profile of the forming roller set, the forming roller set profiles of at least two forming roller sets being different from each other; and an actuating unit operably coupled to the plurality of forming roller sets, wherein the actuating unit is configured to control a configuration of the inner forming rollers and the outer forming rollers of the plurality of forming roller sets so as to control a timing of the engagement and a disengagement of the plurality of forming roller sets with the ring component, wherein the actuating unit is further configured to engage each of the forming roller sets so as to form each forming roller set profile on at least 360 degrees of the ring component, and wherein the timing of the engagement of each forming roller set with the ring component is staggered with respect to each of the other forming roller sets.

2. The system of claim 1, wherein the actuating unit is configured to control the engagement and the disengagement of each forming roller set by changing a distance between the inner forming roller and the outer forming of the forming roller set.

3. The system of claim 1, wherein the plurality of forming roller sets comprises a first forming roller set comprising a first forming roller set profile and a final forming roller set adjacent to the first forming roller set comprising a final forming roller set profile, and one or more intermediate forming roller sets, each intermediate forming roller set comprising an intermediate forming roller set profile.

4. The system of claim 3, wherein the actuating unit is further configured to:

engage the first forming roller set with the ring component while the intermediate forming roller sets and final forming roller set are disengaged from the ring component;

engage the one or more intermediate forming roller sets with the ring component one after the other while the first forming roller set is engaged with the ring component;

engage the final forming roller set with the ring component while the first forming roller set and the one or more intermediate forming roller sets are engaged with the ring component;

disengage the first forming roller set from the ring component while the final forming roller set and the one or more intermediate forming roller sets are engaged with the ring component;

disengage the one or more intermediate forming roller sets from the ring component one after the other after the first forming roller set is disengaged from the ring component and while the final forming roller set is engaged with the ring component; and disengage the final forming roller set after the one or more intermediate forming roller sets are disengaged from the ring component.

5. The system of claim 4, wherein the actuating unit is further configured to:

engage at least one intermediate forming roller set with the ring component after a portion of the ring component formed with the first forming roller set profile of the first forming roller set passes the at least one intermediate forming roller set; and engage the final forming roller set with the ring component after a portion of the ring component formed with the intermediate forming roller set profile of an adjacent intermediate forming roller set passes the final forming roller set.

6. The system of claim 1, wherein the actuating unit is further configured to disengage each forming roller set from the ring component at least after a whole circumference of the ring component has been formed with the corresponding forming roller set.

7. The system of claim 1, wherein the forming roller set profiles of the plurality of forming roller sets are different from each other.

8. The system of claim 1, further comprising one or more non-forming roller sets configured to selectively engage with and disengage from the ring component, wherein the actuating unit is further configured to engage the one or more non-forming roller sets with the ring component at least while at least one forming roller set from the plurality of forming roller sets is engaged with the ring component.

9. The system of claim 1, further comprising a heating element disposed between at least two forming roller sets from the plurality of forming roller sets, wherein the heating element is configured to locally heat a portion of the ring component disposed between the at least two forming roller sets.

10. A method for contouring a ring component, the method comprising:

providing a plurality of forming roller sets, each of the plurality of forming roller sets comprising an inner forming roller configured to rotate about an inner forming roller axis, and an outer forming roller configured to rotate about an outer forming roller axis, the forming roller sets being arranged around a system axis such that a ring component can pass between the inner forming roller and outer forming roller of each forming roller set, the inner forming roller axis being closer to the system axis than the outer forming roller axis, each forming roller set being adjustable between at least an engagement configuration and a disengagement configuration, wherein, when in the engagement configuration, the inner forming roller and the outer forming roller of the forming roller set define in a space therebetween a forming roller set profile, such that, upon an engagement with the ring component, each forming roller set is configured to form a profile on the ring component based on the forming roller set profile of the forming roller set, the forming roller set profiles of at least two forming roller sets being different from each other;

selectively engaging the plurality of forming roller sets with the ring component;

selectively disengaging the plurality of forming roller sets from the ring component; and selectively rotating each forming roller set at least while each forming roller set is engaged with the ring component so as to form each forming roller set profile on at least 360 degrees of the ring component;

wherein the timing of the engagement of each forming roller set with the ring component is staggered with respect to each of the other forming roller sets.

11. The method of claim 10, further comprising:

engaging a first forming roller set from the plurality of forming roller sets with the ring component, while the remaining forming roller sets and the final forming roller set are disengaged from the ring component, wherein the first forming roller set comprises a first forming roller set profile, wherein the one or more intermediate forming roller sets are circumferentially disposed between the first forming roller set and the final forming roller set;

engaging one or more intermediate forming roller sets with the ring component one after the other while the first forming roller set is engaged with the ring component, wherein each intermediate forming roller set comprises an intermediate forming roller set profile;

engaging the final forming roller set with the ring component while the first forming roller set and the one or more intermediate forming roller sets are engaged with the ring component, wherein the final forming roller set comprises a final forming roller set profile;

disengaging the first forming roller set from the ring component while the final forming roller set and the one or more intermediate forming roller sets are engaged with the ring component;

disengaging the one or more intermediate forming roller sets from the ring component one after the other after the first forming roller set is disengaged from the ring component and while the final forming roller set is engaged with the ring component; and disengaging the final forming roller set after the one or more intermediate forming roller sets are disengaged from the ring component.

12. The method of claim 11, wherein:

engaging the one or more intermediate forming roller sets with the ring component further comprises engaging at least one intermediate forming roller set with the ring component after a portion of the ring component formed with the forming roller set profile of a previous adjacent forming roller set passes the at least one intermediate forming roller set; and engaging the final forming roller set with the ring component further comprises engaging the final forming roller set with the ring component after a portion of the ring component formed with the intermediate forming roller set profile of an adjacent intermediate forming roller set passes the final forming roller set.

13. The method of claim 11, further comprising disengaging each roller set at least after a whole circumference of the ring component is formed with the corresponding forming roller set.

14. The method of claim 11, further comprising selectively engaging one or more non-forming roller sets with the ring component at least while at least one forming roller set from the plurality of forming roller sets is engaged with the ring component.

15. The method of claim 11, further comprising locally heating a portion of the ring component disposed between at least two forming roller sets from the plurality of forming roller sets.

* * * * *